US009415992B2

(12) United States Patent
Ryan et al.

(10) Patent No.: US 9,415,992 B2
(45) Date of Patent: Aug. 16, 2016

(54) DISPENSER FOR BEVERAGES HAVING A ROTARY MICRO-INGREDIENT COMBINATION CHAMBER

(75) Inventors: Christopher Thomas Ryan, East Brunswick (AU); Edwin Petrus Elisabeth van Opstal, Langwarrin (AU); Kenneth Heng-Chong Ng, Donvale (AU); Sasha Miu, Brunswick (AU)

(73) Assignee: The Coca-Cola Company, Atlanta, GA (US)

( * ) Notice: Subject to any disclaimer, the term of this patent is extended or adjusted under 35 U.S.C. 154(b) by 688 days.

(21) Appl. No.: 13/477,119

(22) Filed: May 22, 2012

(65) Prior Publication Data

US 2012/0228328 A1 Sep. 13, 2012

Related U.S. Application Data

(63) Continuation-in-part of application No. 11/777,309, filed on Jul. 13, 2007, now Pat. No. 8,960,500, and a continuation-in-part of application No. 11/276,549, filed on Mar. 6, 2006.

(51) Int. Cl.
*B67D 7/74* (2010.01)
*B67D 1/00* (2006.01)
(Continued)

(52) U.S. Cl.
CPC ..... *B67D 1/0025* (2013.01); *B01F 7/00216* (2013.01); *B01F 13/0059* (2013.01); *B01F 15/00064* (2013.01); *B01F 15/0203* (2013.01); *B01F 15/026* (2013.01); *B67D 1/0034* (2013.01); *B67D 1/0043* (2013.01); *B67D 1/0044* (2013.01); *B67D 1/0047* (2013.01); *B67D 1/07* (2013.01); *B67D 1/0857* (2013.01);
(Continued)

(58) Field of Classification Search
CPC ..... B01F 15/026; B01F 13/0059; B01F 15/0203; B67D 1/0025; B67D 1/0043; B67D 1/0044; B67D 1/0046; B67D 1/0047; B67D 1/0034
USPC ..... 222/129.4, 48, 129.1, 129.3, 144.5
See application file for complete search history.

(56) References Cited

U.S. PATENT DOCUMENTS 667,301 A 2/1901 Dredge
1,409,827 A 3/1922 Fredrick
(Continued)

FOREIGN PATENT DOCUMENTS

AT 319795 1/1975
DE 37 09 155 A1 10/1987
(Continued)

OTHER PUBLICATIONS

Lancer, Title: "Redirect your store traffic from the cooler to your more profitable post-mix fountain area by adding fun and creating excitement!"; FS Series, dated Apr. 2003; pp. 1-4.

*Primary Examiner* — J. Casimer Jacyna
(74) *Attorney, Agent, or Firm* — Sutherland Asbill & Brennan LLP

(57) ABSTRACT

The present application provides a beverage dispenser. The beverage dispenser may include a number of micro-ingredients, a water stream, and a rotary chamber. The rotary chamber may include a first element in communication with the micro-ingredients and the water stream and a second element maneuverable to a dispense position and a sealed position.

20 Claims, 23 Drawing Sheets

(51) Int. Cl.

| | |
|---|---|
| ***B01F 7/00*** | (2006.01) |
| ***B01F 13/00*** | (2006.01) |
| ***B01F 15/00*** | (2006.01) |
| ***B01F 15/02*** | (2006.01) |
| ***B67D 1/07*** | (2006.01) |
| ***B67D 1/08*** | (2006.01) |

(52) U.S. Cl.
CPC ..... *B67D 1/0895* (2013.01); *B67D 2210/0006* (2013.01)

(56) References Cited

U.S. PATENT DOCUMENTS 1,758,552 A * 5/1930 Allen ..... B67D 1/0083 137/625.11
2,536,686 A 1/1951 Housekeeper et al.
3,364,959 A 1/1968 Herman et al.
3,618,642 A 11/1971 Beaulieu
3,664,550 A 5/1972 Carothers et al.
3,723,851 A 3/1973 Langford et al.
3,759,422 A 9/1973 Matheney
3,822,056 A 7/1974 Hawes et al.
3,915,207 A 10/1975 Greenfield, Jr. et al.
3,951,303 A 4/1976 Hobden et al.
4,211,342 A 7/1980 Jamgochian et al.
4,282,698 A 8/1981 Zimmermann
4,338,982 A 7/1982 Terminiello et al.
4,444,336 A 4/1984 Nielsen
4,703,609 A 11/1987 Yoshida et al.
4,753,370 A 6/1988 Rudick
4,779,761 A 10/1988 Rudick et al.
4,793,520 A 12/1988 Gerber
4,827,426 A 5/1989 Patton et al.
4,830,511 A 5/1989 Smazik
4,860,923 A 8/1989 Kirschner et al.
4,881,663 A 11/1989 Seymour
4,884,720 A * 12/1989 Whigham et al. ..... 222/54
4,889,148 A 12/1989 Smazik
4,890,774 A 1/1990 Poore
4,923,093 A 5/1990 Gerber
4,934,567 A 6/1990 Vahjen et al.
4,944,337 A 7/1990 Credle, Jr. et al.
4,951,719 A 8/1990 Wiley et al.
4,955,507 A 9/1990 Kirschner et al.
4,961,447 A 10/1990 Credle, Jr. et al.
4,967,808 A 11/1990 Credle, Jr. et al.
4,971,120 A 11/1990 Credle, Jr. et al.
5,000,345 A 3/1991 Brogna et al.
5,058,630 A 10/1991 Wiley et al.
5,074,341 A 12/1991 Credle, Jr. et al.
5,129,548 A 7/1992 Wisniewski
5,192,000 A 3/1993 Wandrick et al.
5,292,030 A 3/1994 Kateman et al.
5,341,957 A 8/1994 Sizemore
5,400,838 A 3/1995 Schjerven et al.
5,433,967 A 7/1995 Kateman et al.
5,465,870 A 11/1995 Sizemore
5,473,909 A 12/1995 Kateman et al.
5,603,257 A 2/1997 Kateman et al.
5,725,125 A 3/1998 Bessette et al.
5,727,713 A 3/1998 Kateman et al.
5,758,571 A 6/1998 Kateman et al.
5,778,761 A 7/1998 Miller
5,803,320 A 9/1998 Cutting et al.
5,868,065 A 2/1999 Haggerty et al.
5,878,964 A 3/1999 Hansen
5,890,626 A 4/1999 Wolski et al.
5,975,365 A 11/1999 Hsieh
5,980,969 A 11/1999 Mordini et al.
6,053,359 A 4/2000 Goulet et al.
6,102,246 A 8/2000 Goulet et al.
6,126,983 A 10/2000 Miller
6,170,707 B1 1/2001 Wolski et al.
6,173,862 B1 1/2001 Buca et al.
6,186,193 B1 2/2001 Phallen et al.
6,350,484 B1 2/2002 Ault
6,421,583 B1 7/2002 Sudolcan et al.
6,435,375 B2 8/2002 Durham et al.
6,446,834 B2 9/2002 Davis et al.
6,496,752 B2 12/2002 Sudolcan et al.
6,536,626 B2 3/2003 Newman et al.
6,550,641 B2 4/2003 Newman et al.
6,550,642 B2 4/2003 Newman et al.
6,588,725 B1 7/2003 Wisnieski et al.
6,600,968 B2 7/2003 Sudolcan et al.
6,650,962 B2 11/2003 Sudolcan et al.
6,669,053 B1 12/2003 Gardon et al.
6,689,410 B2 2/2004 Gerber
6,694,748 B2 2/2004 Sergio et al.
6,698,228 B2 3/2004 Kateman et al.
6,745,595 B1 6/2004 Kateman et al.
6,751,525 B1 6/2004 Crisp, III
6,756,069 B2 6/2004 Scoville et al.
6,763,860 B2 7/2004 Jungmann et al.
6,766,656 B1 7/2004 Crisp, III et al.
6,889,603 B2 * 5/2005 Carhuff et al. ..... 99/452
6,889,722 B2 5/2005 Huss
6,907,741 B2 6/2005 Kateman
6,934,602 B2 8/2005 Sudolcan et al.
6,941,858 B2 9/2005 Kateman
6,952,928 B2 10/2005 Kateman et al.
6,957,125 B1 10/2005 Rifkin
6,983,863 B2 1/2006 Santy, Jr.
6,994,231 B2 2/2006 Jones
7,077,290 B2 7/2006 Bethuy et al.
7,108,024 B2 9/2006 Navarro
7,108,156 B2 9/2006 Fox
7,147,131 B2 12/2006 Sher et al.
7,156,115 B2 1/2007 Everett et al.
7,156,259 B2 1/2007 Bethuy et al.
7,159,743 B2 1/2007 Brandt et al.
7,162,391 B2 1/2007 Knepler et al.
7,164,966 B2 1/2007 Sudoican
7,168,593 B2 1/2007 Schroeder et al.
7,203,572 B2 4/2007 Crips, III
7,243,818 B2 7/2007 Jones
7,320,416 B2 1/2008 Miller et al.
7,325,485 B2 2/2008 Carhuff et al.
7,331,483 B2 2/2008 Bhimani et al.
7,347,344 B2 3/2008 Engels et al.
7,353,080 B2 4/2008 Walker et al.
7,464,835 B2 12/2008 Caronado et al.
7,540,310 B2 6/2009 Huss
7,640,755 B1 1/2010 Kateman
7,669,737 B2 * 3/2010 Bethuy ..... B67D 1/0021 222/129.1
8,369,988 B2 * 2/2013 Schlagel ..... 700/243
2003/0012864 A1 1/2003 Gerber
2003/0015546 A1 1/2003 Stettes et al.
2003/0097314 A1 5/2003 Crisp, II et al.
2003/0194332 A1 10/2003 Jahn et al.
2003/0227820 A1 12/2003 Parrent
2004/0026447 A1 2/2004 Badin et al.
2004/0026452 A1 2/2004 Santiago et al.
2004/0040983 A1 3/2004 Ziesel
2004/0071841 A1 4/2004 Carhuff et al.
2004/0103033 A1 5/2004 Reade et al.
2004/0170727 A1 9/2004 Howard et al.
2004/0217129 A1 11/2004 Roekens et al.
2005/0029287 A1 2/2005 Mobbs
2005/0121466 A1 6/2005 Sher et al.
2005/0166761 A1 8/2005 Jones et al.
2005/0166766 A1 8/2005 Jones et al.
2005/0175767 A1 8/2005 Gerber
2005/0178793 A1 8/2005 Cheng et al.
2005/0201196 A1 9/2005 Gerber
2005/0269360 A1 12/2005 Piatnik et al.
2005/0284885 A1 12/2005 Kadyk et al.
2006/0036454 A1 2/2006 Henderson
2006/0054614 A1 3/2006 Baxter et al.
2006/0081653 A1 4/2006 Bolland et al.
2006/0097009 A1 5/2006 Bethuy et al.
2006/0157504 A1 7/2006 Barker et al.
2006/0172056 A1 8/2006 Tobin et al.

(56) References Cited

U.S. PATENT DOCUMENTS

| | | | |
|---|---|---|---|
| 2006/0174778 | A1 | 8/2006 | Greiwe |
| 2006/0180610 | A1 | 8/2006 | Haskayne |
| 2006/0191964 | A1 | 8/2006 | Ziesel |
| 2006/0213928 | A1 | 9/2006 | Ufheil et al. |
| 2007/0009365 | A1 | 1/2007 | Litterst et al. |
| 2007/0051747 | A1 | 3/2007 | Landers et al. |
| 2007/0114243 | A1 | 5/2007 | Kershaw et al. |
| 2007/0114244 | A1 | 5/2007 | Gatipon et al. |
| 2007/0205221 | A1 | 9/2007 | Carpenter et al. |
| 2007/0251260 | A1 | 11/2007 | Baxter et al. |
| 2007/0255450 | A1 | 11/2007 | Mazur et al. |
| 2007/0267441 | A1 | 11/2007 | van Opstal et al. |
| 2007/0272317 | A1 | 11/2007 | Klopfenstein et al. |
| 2008/0004954 | A1 | 1/2008 | Horvitz |
| 2008/0023488 | A1 | 1/2008 | Guerrero et al. |
| 2008/0029541 | A1 | 2/2008 | Wallace et al. |
| 2008/0041876 | A1 | 2/2008 | Frank et al. |
| 2008/0050480 | A1 | 2/2008 | Doglioni Majer |
| 2008/0283550 | A1 | 11/2008 | Nighy et al. |
| 2009/0069949 | A1 | 3/2009 | Carpenter et al. |
| 2009/0323462 | A1 | 12/2009 | Cocchi et al. |

FOREIGN PATENT DOCUMENTS

| | | | |
|---|---|---|---|
| EP | 0104447 | A2 | 4/1984 |
| EP | 0105017 | B1 | 4/1984 |
| EP | 0112638 | A2 | 7/1984 |
| EP | 0136005 | A1 | 4/1985 |
| EP | 0158096 | A2 | 10/1985 |
| EP | 0175815 | A2 | 4/1986 |
| EP | 07869948 | B1 | 8/1997 |
| EP | 0083467 | A1 | 7/1998 |
| EP | 0958234 | B1 | 11/1999 |
| EP | 1460029 | | 9/2004 |
| EP | 1905730 | | 4/2008 |
| EP | 1910095 | | 4/2008 |
| GB | 898 050 | A | 6/1962 |
| GB | 2429697 | | 9/2005 |
| GB | 2429694 | | 7/2007 |
| GB | 2442223 | | 4/2008 |
| JP | 09134481 | | 5/1997 |
| WO | 8809766 | | 12/1988 |
| WO | 9850165 | A1 | 11/1998 |
| WO | 00/68136 | | 5/2000 |
| WO | 0065316 | A1 | 11/2000 |
| WO | 02/057178 | | 7/2002 |
| WO | 02059035 | A2 | 8/2002 |
| WO | 03107110 | A1 | 12/2003 |
| WO | 2004036515 | A1 | 4/2004 |
| WO | 2005018788 | A1 | 3/2005 |
| WO | 2005/068836 | | 7/2005 |
| WO | 2005/070816 | | 8/2005 |
| WO | 2005/102906 | | 11/2005 |
| WO | 2005/111955 | | 11/2005 |
| WO | 2005111955 | A1 | 11/2005 |
| WO | 2006/012916 | | 2/2006 |
| WO | 2006/013362 | | 2/2006 |
| WO | 2006019523 | | 2/2006 |
| WO | 2006/076733 | | 7/2006 |
| WO | 2006/070257 | | 10/2006 |
| WO | 2007/002575 | | 1/2007 |
| WO | 2007/070032 | | 6/2007 |
| WO | 2008/015097 | | 2/2008 |

* cited by examiner 1000
110
1110
1120
1130
1140
1150
1160
1170
1180
1190
1200
1210
1220
1230
1240
1250
1260
1270
1280
1290
1300
1310
1320
1330
1340
1350
1360
1370
1380
1390
1400
1410
1420
1430
1440
1450
1460
1470
1480
1490
1500

Fig. 21
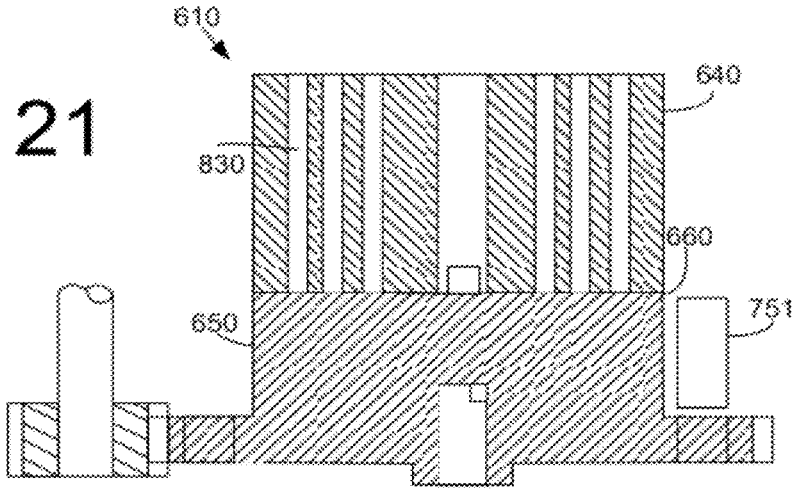
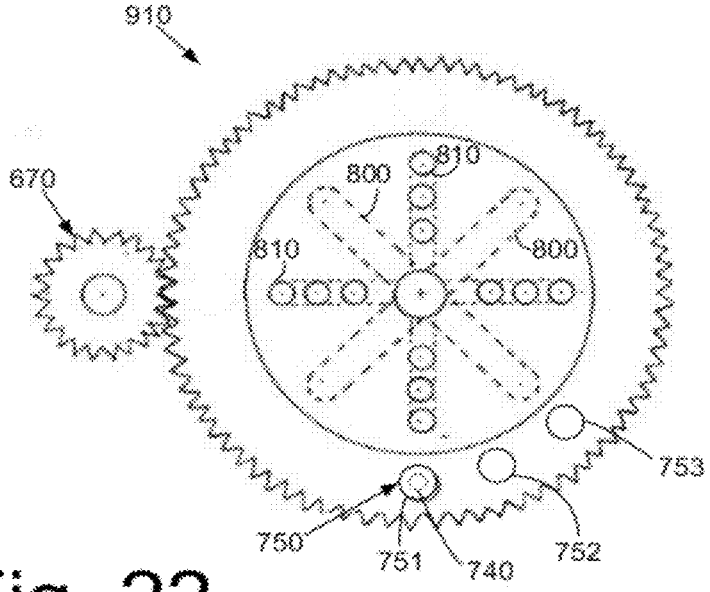
Fig. 22

FIG. 34
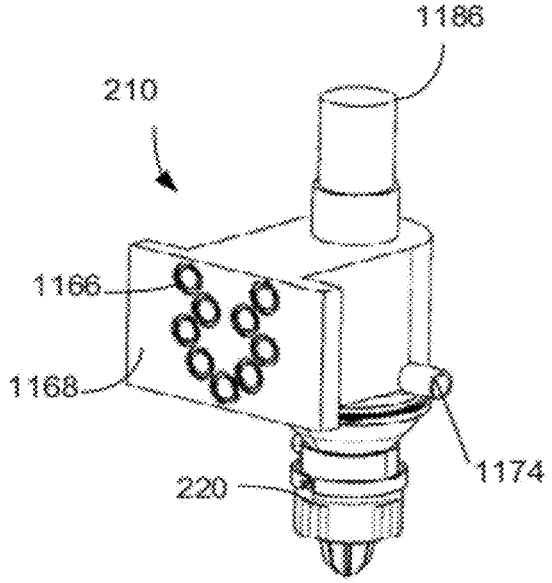
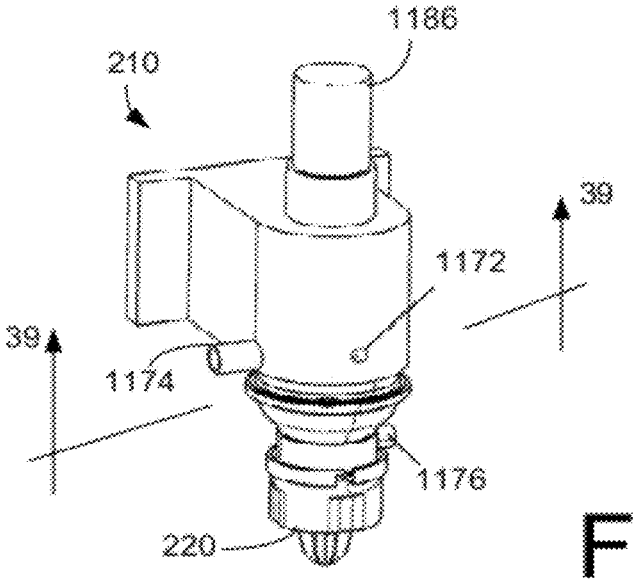
FIG. 35

FIG. 41
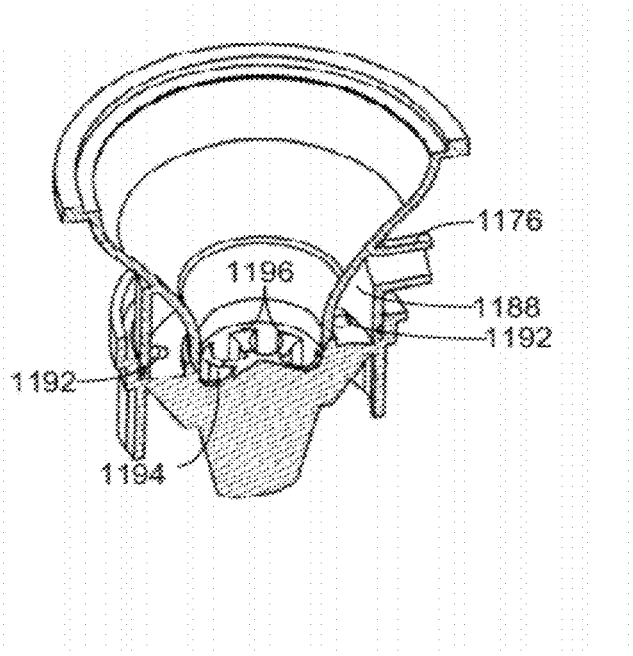
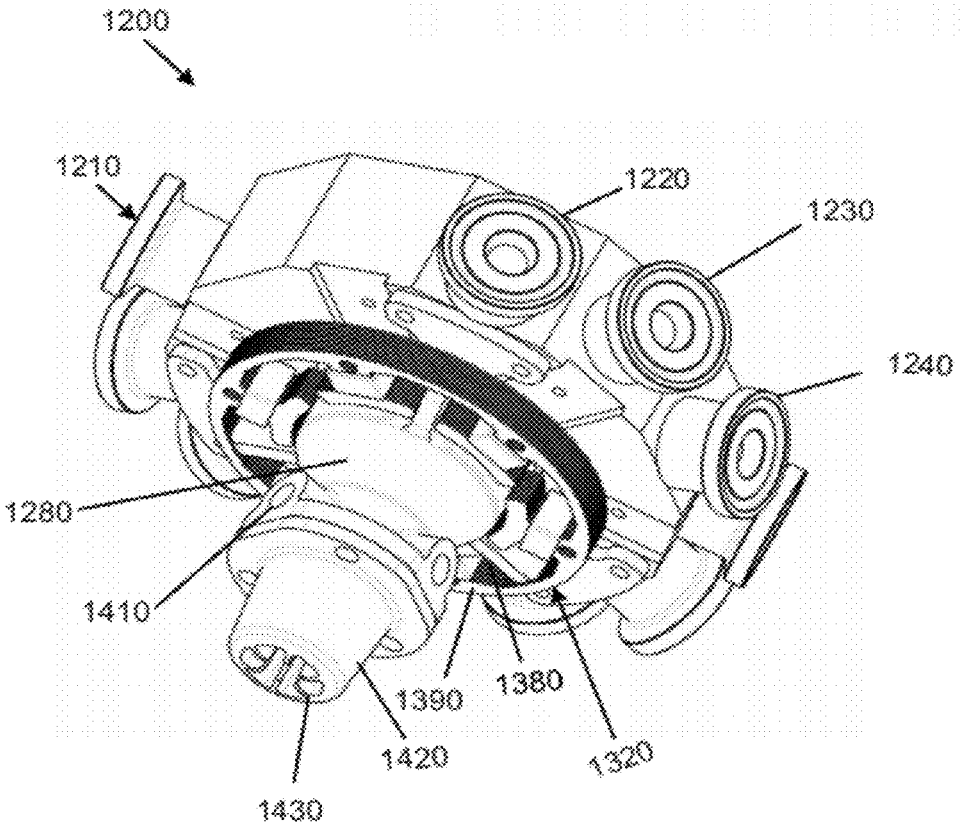
FIG. 42

DISPENSER FOR BEVERAGES HAVING A ROTARY MICRO-INGREDIENT COMBINATION CHAMBER

RELATED APPLICATIONS

The present application is a continuation-in-part of U.S. patent application Ser. No. 11/777,309, filed on Jul. 13, 2007, entitled "DISPENSER FOR BEVERAGES INCLUDING JUICES", now pending, which, in turn, is a continuation-in-part of U.S. patent application Ser. No. 11/276,549, filed on Mar. 6, 2006, entitled "JUICE DISPENSING SYSTEM", now pending. U.S. patent application Ser. Nos. 11/777,309 and 11/276,649 are incorporated by reference herein in full.

TECHNICAL FIELD

The present application relates generally to a beverage dispenser and more particularly relates to a juice dispenser or any other type of beverage dispenser that may be capable of dispensing a number of beverage alternatives on demand from a number of micro-ingredients and other types of ingredients.

BACKGROUND OF THE INVENTION

Commonly owned U.S. Pat. No. 4,753,370 concerns a "Tri-Mix Sugar Based Dispensing System," This patent describes a beverage dispensing system that separates the highly concentrated flavoring from the sweetener and the diluent. This separation allows for the creation of numerous beverage options using several flavor modules and one universal sweetener. One of the objectives described therein is to allow a beverage dispenser to provide as many beverages as may be available on the market in prepackaged bottles or cans. U.S. Pat. No. 4,753,370 is incorporated herein by reference in full.

These separation techniques, however, generally have not been applied to juice dispensers and the like. Rather, juice dispensers typically have a one (1) to one (1) correspondence between the juice concentrate stored in the dispenser and the products dispensed therefrom. As such, consumers generally can only choose from a relatively small number of products given the necessity for a significant amount of storage space for the concentrate. A conventional juice dispenser thus requires a large footprint in order to offer a wide range of different products.

Another issue with known juice dispensers is that the last mouthful of juice in the cup may not be mixed properly such that a large "slug" of undiluted concentrate may remain. This problem may be caused by insufficient agitation of the viscous juice concentrate. The result often may be an unpleasant taste and an unsatisfactory beverage.

Thus, there is a desire for an improved beverage dispenser that may accommodate a wide range of different beverages. Preferably, the beverage dispenser may offer a wide range of juice-based products or other types of beverages within a footprint of a reasonable size. Further, the beverages offered by the beverage dispenser should be properly mixed throughout.

SUMMARY OF THE INVENTION

The present application and the resultant patent thus provide a beverage dispenser. The beverage dispenser may include a number of micro-ingredients, a water stream, and a rotary chamber. The rotary chamber may include a first element in communication with the micro-ingredients and the water stream and a second element maneuverable to a dispense position and a sealed position.

The present application and the resultant patent further provide a method of operating a beverage dispenser with micro-ingredients therein. The method may include the steps of rotating a rotating element of a rotary combination chamber to a dispense position, flowing a first number of micro-ingredients through the rotary combination chamber, rotating the rotating element to a wash position, flowing a flow of water through the rotary combination chamber, rotating the rotating element to the dispense position, and dispensing a second number of micro-ingredients through the rotary combination chamber.

The present application and the resultant patent further provide a beverage dispenser. The beverage dispenser may include a number of micro-ingredients, a rotary chamber with a fixed element in communication with the plurality of micro-ingredients and a rotating element, and a number of dispensing nozzles in communication with the rotating element of the rotary chamber.

These and other features and improvements of the present application and the resultant patent will become apparent to one of ordinary skill in the art upon review of the following detailed description when taken in conjunction with the several drawings and the appended claims.

BRIEF DESCRIPTION OF DRAWINGS

FIG. 21 is a further side cross-sectional view of the rotary combination chamber of FIG. 18.

FIG. 22 is a top plan view of a further embodiment of a rotary combination chamber as may be described herein.

FIG. 34 is a perspective view of a mixing module as may be used in the beverage dispenser of FIG. 1.

FIG. 35 is a further perspective view of the mixing module of FIG. 34.

FIG. 41 is a side cross-sectional view of the mixing module and the nozzle of FIG. 40 shown in perspective.

FIG. 42 is a perspective view of an alternative embodiment of a mixing module as may be used with the beverage dispenser of FIG. 1.

DETAILED DESCRIPTION

Figure 1:
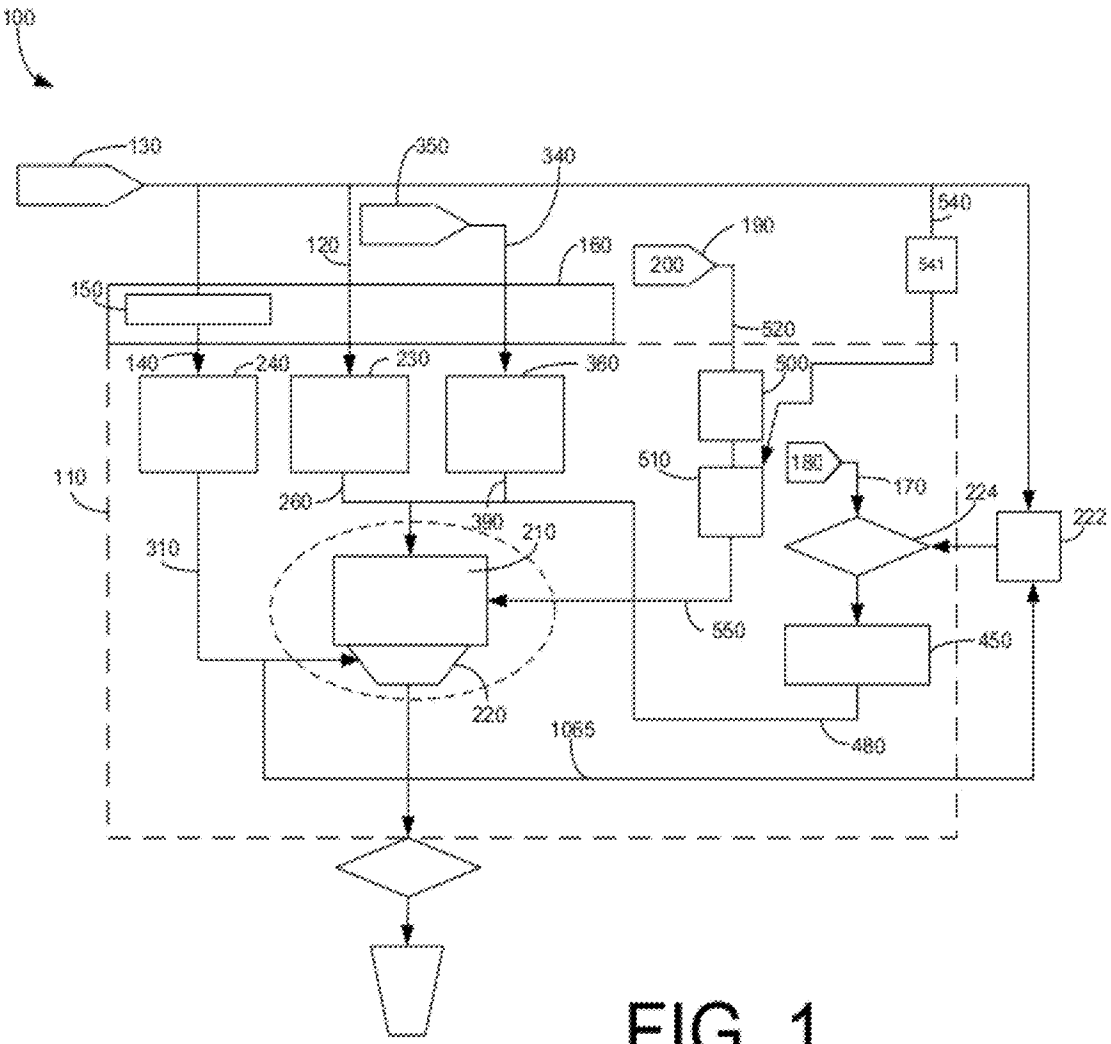
FIG. 1 is a schematic view of a beverage dispenser as may be described herein.

Referring now to the drawings, in which like numerals refer to like elements throughout the several views, FIG. 1 shows a schematic view of a beverage dispenser 100 as is described herein. Those portions of the beverage dispenser 100 that may be within a refrigerated compartment 110 are shown within the dashed lines while the non-refrigerated ingredients are shown outside. Other refrigeration configurations may be used herein.

The dispenser 100 may use any number of different ingredients. By way of example, the dispenser 100 may use plain water 120 (still water or noncarbonated water) from a water source 130; carbonated water 140 from a carbonator 150 in communication with the water source 130 (the carbonator 150 and other elements may be positioned within a chiller 160); a number of macro-ingredients 170 from a number of macro-ingredient sources 180; and a number of micro-ingredients 190 from a number of micro-ingredient sources 200. Many other types of ingredients and combinations thereof also may be used herein.

Generally described, the macro-ingredients 170 have reconstitution ratios in the range from full strength (no dilution) to about six (6) to one (1) (but generally less than about ten (10) to one (1)). The macro-ingredients 170 may include juice concentrates, sugar syrup, HFCS ("High Fructose Corn Syrup"), concentrated extracts, purees, or similar types of ingredients. Other ingredients may include dairy products, soy, rice concentrates. Similarly, a macro-ingredient based product may include the sweetener as well as flavorings, acids, and other common components. The juice concentrates and dairy products generally may require refrigeration. The sugar, or other macro-ingredient base products generally may be stored in a conventional bag-in-box container remote from the dispenser 100. The viscosities of the macro-ingredients may range from about one (1) to about 10,000 centipoise and generally over 100 centipoise.

The micro-ingredients 190 may have reconstitution ratios ranging from about ten (10) to one (1) and higher. Specifically, many micro-ingredients 190 may have reconstitution ratios in the range of 50:1 to 300:1 or higher. The viscosities of the micro-ingredients 190 typically may range from about one (1) to about six (6) centipoise or so, but may vary from this range. Examples of micro-ingredients 190 include natural or artificial flavors; flavor additives; natural or artificial colors; artificial sweeteners (high potency or otherwise); additives for controlling tartness, e.g., citric acid or potassium citrate; functional additives such as vitamins, minerals, herbal extracts, nutricuticals; and over the counter (or otherwise) medicines such as pseudoephedrine, acetaminophen; and similar types of materials. Various types of alcohols may be used as either micro or macro-ingredients. The micro-ingredients 190 may be in liquid, gaseous, or powder form (and/or combinations thereof including soluble and suspended ingredients in a variety of media, including water, organic solvents and oils). The micro-ingredients 190 may or may not require refrigeration and may be positioned within the dispenser 100 accordingly. Non-beverage substances such as paints, dies, oils, cosmetics, etc. also may be used and dispensed in a similar manner.

The water 120, the carbonated water 140, the macro-ingredients 170 (including the HFCS), and the micro-ingredients 190 may be pumped from their various sources 130, 150, 180, 200 to a mixing module 210 and a nozzle 220 as will be described in more detail below. Each of the ingredients generally must be provided to the mixing module 210 in the correct ratios and/or amounts.

The dispenser 100 also may include a clean-in-place system 222. The clean-in-place system 192 cleans and sanitizes the components of the dispenser 100 on a scheduled basis and/or as desired. By way of example, the clean-in-place system 222 may communicate with the dispenser 100 as a whole via two locations: a clean-in-place connector 224 and a clean-in-place cap (not shown). The clean-in-place connector 224 may tie into the dispenser 100 near the macro-ingredient sources 180. The clean-in-place connector 224 may function as a three-way valve or a similar type of connection means. The clean-in-place cap may be attached to the nozzle 220 when desired. The clean-in-place cap may circulate a cleaning fluid through the nozzle 220 and the dispenser 100. Other types of cleaning techniques may be used herein.

Figure 2:
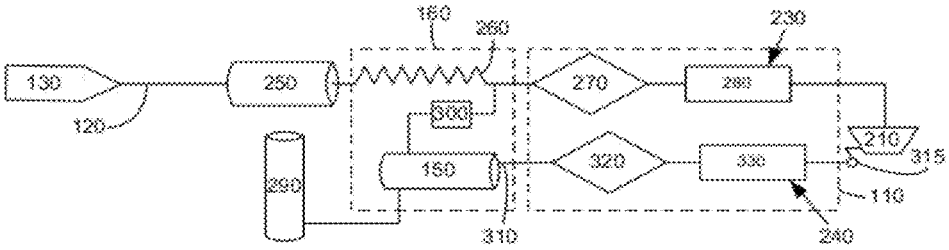
FIG. 2 is a schematic view of a water metering system and a carbonated water metering system as may be used in the beverage dispenser of FIG. 1.

When dispensing, the water 120 may be delivered from the water source 130 to the mixing nozzle 210 via a water metering system 230 while the carbonated water 140 is delivered from the carbonator 150 to the nozzle 220 via a carbonated water metering system 240. As is shown in FIG. 2, the water 120 from the water source 130 may first pass through a pressure regulator 250. The pressure regulator 250 may be of conventional design. The water 120 from the water source 130 will be regulated or boosted to a suitable pressure via the pressure regulator 250. The water then passes through the chiller 160. The chiller 160 may be a mechanically refrigerated water bath with an ice bank therein. A water line 260 passes through the chiller 160 so as to chill the water to the desired temperature. Other chilling methods and devices may be used herein.

The water then flows to the water metering system 230. The water metering system 230 includes a flow meter 270 and a proportional control valve 280. The flow meter 270 provides feedback to the proportional control valve 280 and also may detect a no flow condition. The flow meter 270 may be a paddle wheel device, a turbine device, a gear meter, or any type of conventional metering device. The flow meter 270 may be accurate to within about 2.5 percent or so. A flow rate of about 88.5 milliliters per second may be used although any other flow rates may be used herein. The pressure drop across the chiller 160, the flow meter 270, and the proportional control valve 280 should be relatively low so as to maintain the desired flow rate.

The proportional control valve 280 ensures that the correct ratio of the water 120 to the carbonated water 140 is provided to the mixing module 210 and the nozzle 220 and/or to ensure that the correct flow rate is provided to the mixing module 210 and the nozzle 220. The proportional control valve may operate via pulse width modulation, a variable orifice, or other conventional types of control means. The proportional control valve 280 should be positioned physically close to the mixing nozzle 210 so as to maintain an accurate ratio.

Likewise, the carbonator 150 may be connected to a gas cylinder 290. The gas cylinder 290 generally includes pressurized carbon dioxide or similar gases. The water 120 within the chiller 160 may be pumped to the carbonator 150 by a water pump 300. The water pump 300 may be of conventional design and may include a vane pump and similar types of designs. The water 120 is carbonated by conventional means to become the carbonated water 140. The water 120 may be chilled prior to entry into the carbonator 150 for optimum carbonization.

The carbonated water 140 then may pass into the carbonated water metering system 240 via a carbonated waterline 310. A valve 315 on the carbonated line 310 may turn the flow of carbonated water on and off. The carbonated water metering system 240 may also include a flow meter 320 and a proportional control valve 330. The carbonated water flow meter 320 may be similar to the plain water flow meter 270 described above. Likewise, the respective proportional control valves 280, 330 may be similar. The proportional control valve 280 and the flow meter 270 may be integrated in a single unit. Likewise, the proportional control valve 330 and the flow meter 320 may be integrated in a single unit. The proportional control valve 330 also should be located as closely as possible to the nozzle 220. This positioning may minimize the amount of carbonated water in the carbonated waterline 310 and likewise limit the opportunity for carbonation breakout. Bubbles created because of carbonation loss may displace the water in the line 310 and force the water into the nozzle 220 so as to promote dripping.

Figure 3A:
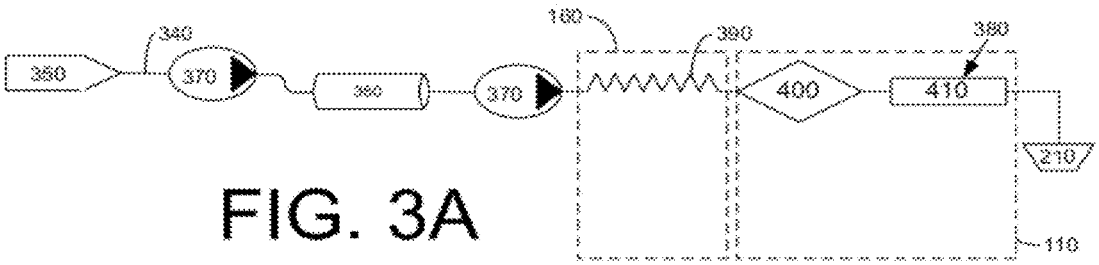
FIG. 3A is a schematic view of a HFCS metering system as may be used in the beverage dispenser of FIG. 1.

One of the macro-ingredients 170 described above includes High Fructose Corn Syrup ("HFCS") 340. The HFCS 340 may be delivered to the mixing module 210 from an HFCS source 350. As is shown in FIG. 3, the HFCS source 350 may be a conventional bag-in-box container or a similar type of container. The HFCS is pumped from the HFCS source 350 via a pump 370. The pump 370 may be a gas assisted pump or a similar type of conventional pumping device. The HFCS source 350 may be located within the dispenser 100 or at a distance from the dispenser 100 as a whole. In the event that a further bag-in-box pump 370 is required, a vacuum regulator 360 may be used to ensure that the inlet of the further bag-in-box pump 370 is not overpressurized. The further bag-in-box pump 370 also may be positioned closer to the chiller 160 depending upon the distance of the HFCS source 350 from the chiller 160. A HFCS line 390 may pass through the chiller 160 such that the HFCS 340 is chilled to the desired temperature.

The HFCS 340 then may pass through a HFCS metering system 380. The HFCS metering system 380 may include a flow meter 400 and a proportional control valve 410. The flow meter 400 may be a conventional flow meter as described above or as that described in commonly owned U.S. Pat. No. 7,584,657, entitled "FLOW SENSOR" and incorporated herein by reference. The flow meter 400 and the proportional control valve 410 ensure that the HFCS 340 is delivered to the mixing module 210 at about the desired flow rate and also to detect no flow conditions and the like.

Figure 3B:
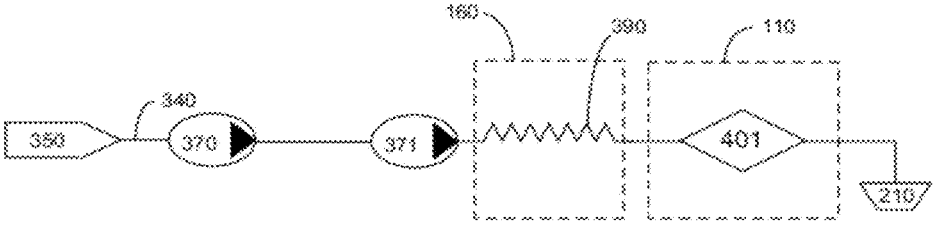
FIG. 3B is a schematic view of an alternative HFCS metering system as may be used in the beverage dispenser of FIG. 1.

FIG. 3B shows an alternate method of HFCS delivery. The HFCS 340 may be pumped from the HFCS source 350 by the bag-in-box pump 370 located close to the HFCS source 350. A second pump 371 may be located close to or inside of the dispenser 100. The second pump 371 may be a positive displacement pump such as a progressive cavity pump. The second pump 371 pumps the HFCS 340 at a precise flow rate through the HFCS line 390 and through the chiller 160 such that the HFCS 340 is chilled to the desired temperature. The HFCS 340 then may pass through an HFCS flow meter 401 similar to that described above. The flow meter 401 and the positive displacement pump 371 ensure that the HFCS 340 is delivered to the mixing module 210 at about the desired flow rate and also detects no flow conditions. If the positive displacement pump 371 can provide a sufficient level of flow rate accuracy without feedback from the flow meter 401, then the system as a whole can be run in an "open loop" manner.

Figure 4A:
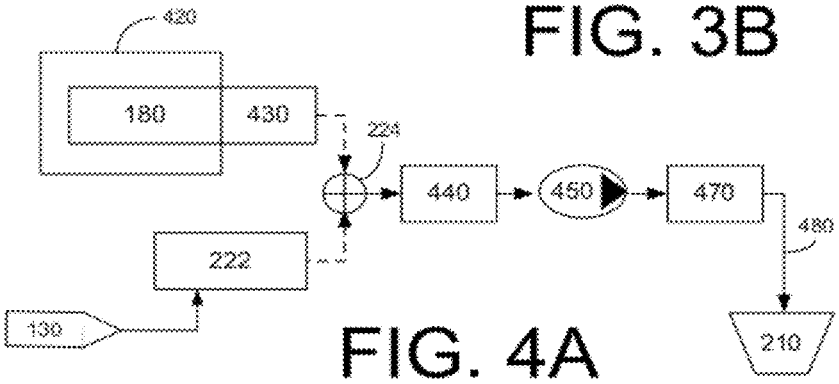
FIG. 4A is a schematic view of a macro-ingredient storage and metering system as may be used in the beverage dispenser of FIG. 1.

Although FIG. 1 shows only a single macro-ingredient source 180, the dispenser 100 may include any number of macro-ingredient 170 and macro-ingredient sources 180. In this example, eight (8) macro-ingredient sources 180 may be used although any number may be used herein. Each macro-ingredient source 180 may be a flexible bag or any conventional type of a container. Each macro-ingredient source 180 may be housed in a macro-ingredient tray 420 or in a similar mechanism or container. Although the macro-ingredient tray 420 will be described in more detail below, FIG. 4A shows the macro-ingredient tray 420 housing a macro-ingredient source 180 having a female fitting 430 so as to mate with a male fitting 440 associated with a macro-ingredient pump 450 via the CIP connector 224. Other types of connection means may be used herein. The macro-ingredient tray 420 and the CIP connector 224 thus can disconnect the macro-ingredient sources 180 from the macro-ingredient pumps 450 for cleaning or replacement. The macro-ingredient tray 420 also may be removable.

The macro-ingredient pump 450 may be a progressive cavity pump, a flexible impeller pump, a peristaltic pump, other types of positive displacement pumps, or similar types of devices. The macro-ingredient pump 450 may be able to pump a range of macro-ingredients 170 at a flow rate of about one (1) to about sixty (60) milliliters per second or so with an accuracy of about 2.5 percent. The flow rate may vary from about five percent (5%) to one hundred percent (100%) flow rate. Other flow rates may be used herein. The macro-ingredient pump 450 may be calibrated for the characteristics of a particular type of macro-ingredient 170. The fittings 430, 440 also may be dedicated to a particular type of macro-ingredient 170.

Figure 4B:
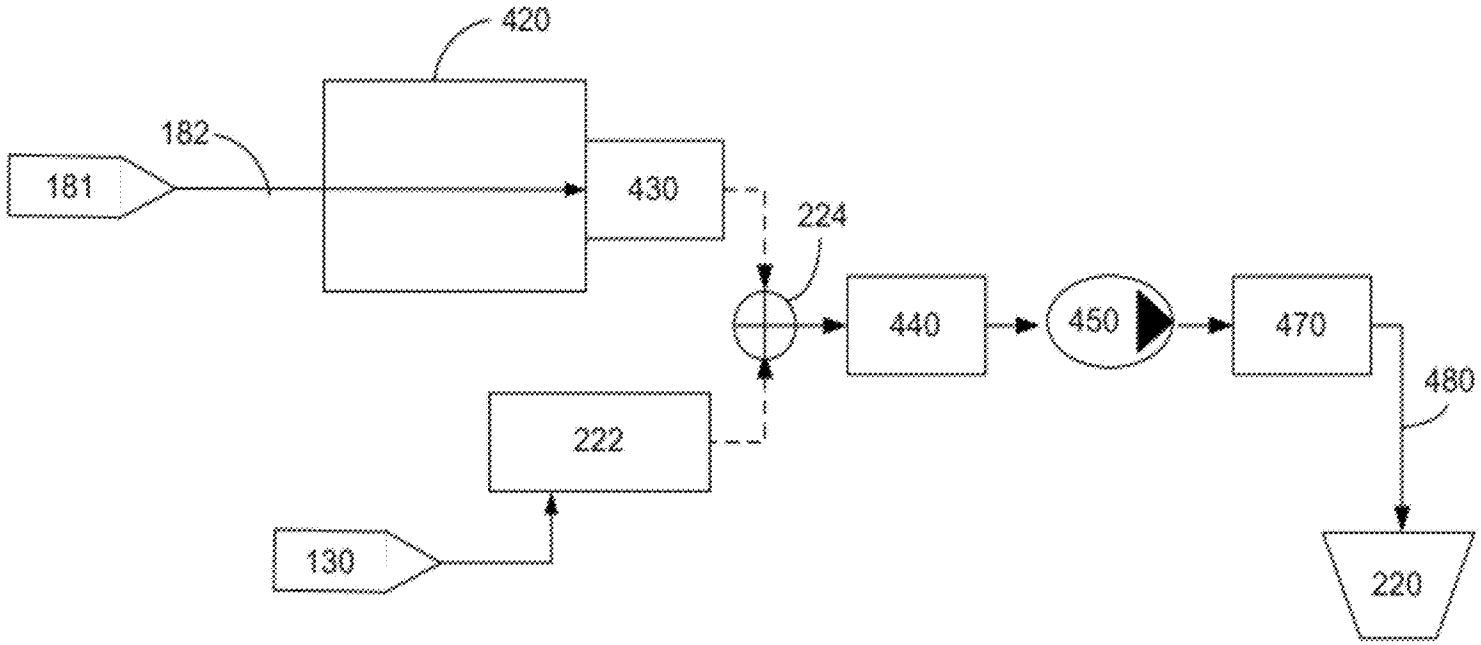
FIG. 4B is a schematic view of a macro-ingredient storage and metering system as may be used in the beverage dispenser of FIG. 1.

A flow sensor 470 may be in communication with the pump 450. The flow sensor 470 may be similar to those described above. The flow sensor 470 ensures the correct flow rate therethrough and detects no flow conditions. A macro-ingredient line 480 may connect the pump 450 and the flow sensor 470 with the mixing module 210. As described above, the system can be operated in a "closed loop" manner in which case the flow sensor 470 measures the macro-ingredient flow rate and provide feedback to the pump 450. If the positive displacement pump 450 can provide a sufficient level of flow rate accuracy without feedback from the flow sensor 470, then the system can be run in an "open loop" manner. Alternatively, a remotely located macro-ingredient source 181 may be connected to the female fitting 430 via a tube 182 as shown in FIG. 4B. The remotely located macro-ingredient source 181 may be located outside of the dispenser 100.

The dispenser 100 also may include any number of micro-ingredients 190. In this example, thirty-two (32) micro-ingredient sources 200 may be used although any number may used herein. The micro-ingredient sources 200 may be positioned within a plastic or a cardboard box to facilitate handling, storage, and loading. Each micro-ingredient source 200 may be in communication with a micro-ingredient pump 500. The micro-ingredient pump 500 may be a positive-displacement pump so as to provide accurately very small doses of the micro-ingredients 190. Similar types of devices may be used herein such as peristaltic pumps, solenoid pumps, piezoelectric pumps, and the like.

Figure 5:
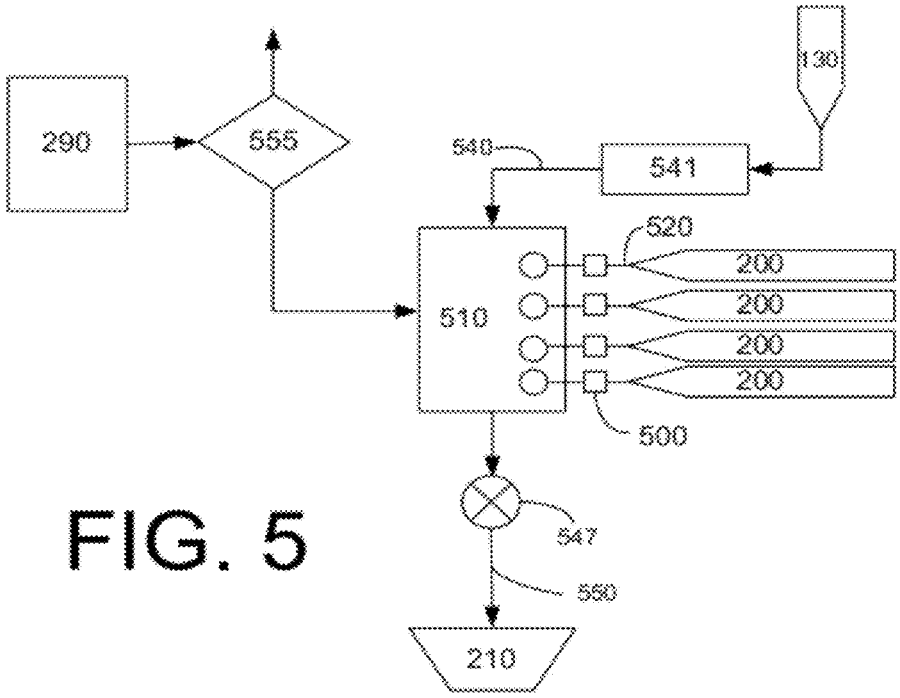
FIG. 5 is a schematic view of a micro-ingredient mixing chamber as may be used in the beverage dispenser of FIG. 1.
Figure 6:
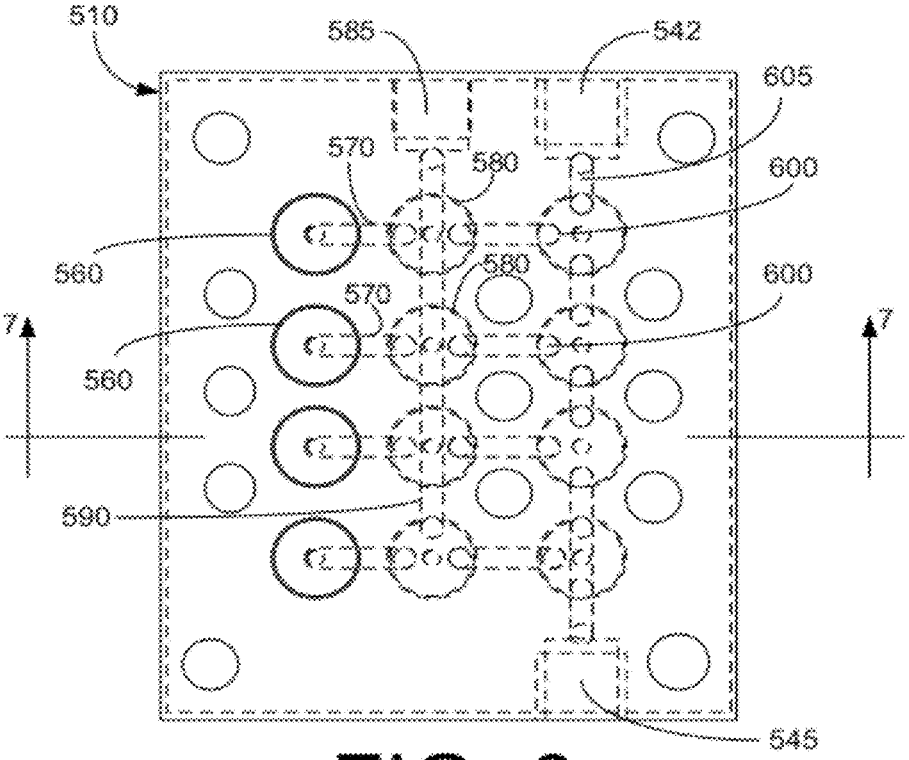
FIG. 6 is a front view of the micro-ingredient mixing chamber of FIG. 5.
Figure 7:
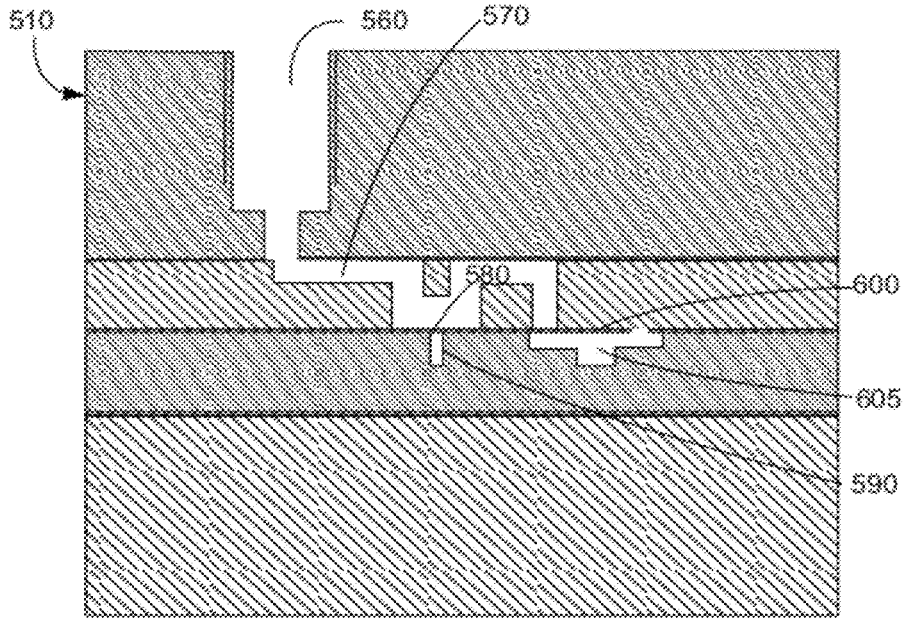
FIG. 7 is a cross-sectional view of the micro-ingredient mixing chamber taken along line 7-7 of FIG. 6.

Each micro-ingredient source 200 may be in communication with a micro-ingredient mixing chamber 510 via a micro-ingredient line 520. Use of the micro-ingredient mixing chamber 510 is shown in FIG. 5. The micro-ingredient mixing chamber 510 may be in communication with an auxiliary waterline 540 that directs a small amount of water 120 from the water source 130. The water 120 flows from the source 130 into the auxiliary waterline 540 through a pressure regulator 541 where the pressure may be reduced to approximately 10 psi or so. Other pressures may be used herein. The water 120 continues through the waterline 540 to a water inlet port 542 and then continues through a central water channel 605 that runs through the micro-ingredient mixing chamber 510. Each of the micro-ingredients 190 is mixed with water 120 within the central water chamber 605 of the micro-ingredient mixing chamber 510. The mixture of water and micro-ingredients exits the micro-ingredient mixing chamber 510 via an exit port 545 and is sent to the mixing module 210 via a combined micro-ingredient line 550 and an on/off valve 547. In this embodiment, the water acts as a carrier for the micro-ingredients 190. The micro-ingredient mixing chamber 510 also may be in communication with the carbon dioxide gas cylinder 290 via a three-way valve 555 and a pneumatic inlet port 585 so as to pressurize and depressurize the micro-ingredient mixing chamber 510 as will be described in more detail below. (The carbon dioxide gas cylinder 290 and associated components need not be used in all embodiments.)

As is shown in FIGS. 6-9, the micro-ingredient mixing chamber 510 may be a multilayer micro-fluidic device. Each micro-ingredient line 520 may be in communication with the micro-ingredient mixing chamber 510 via an inlet port fitting 560 that leads to an ingredient channel 570. The ingredient channel 570 may have a displacement membrane 580 in communication with the pneumatic channel 590 and a one-way membrane valve 600 leading to a central water channel 605 and the combined micro-ingredient line 550. The displacement membrane 580 may be made out of an elastomeric membrane. The membrane 580 may act as a backpressure reduction device in that it may reduce the pressure on the one-way membrane valve 600. Backpressure on the one-way membrane valve 600 may cause leaking of the micro-ingredients 190 through the valve 600. The one-way membrane valve 600 generally remains closed unless micro-ingredients 190 are flowing through the ingredient channel 570 in the preferred direction. All of the displacement membranes 580 and one-way membrane valves 600 may be made from one common membrane.

Figure 8:
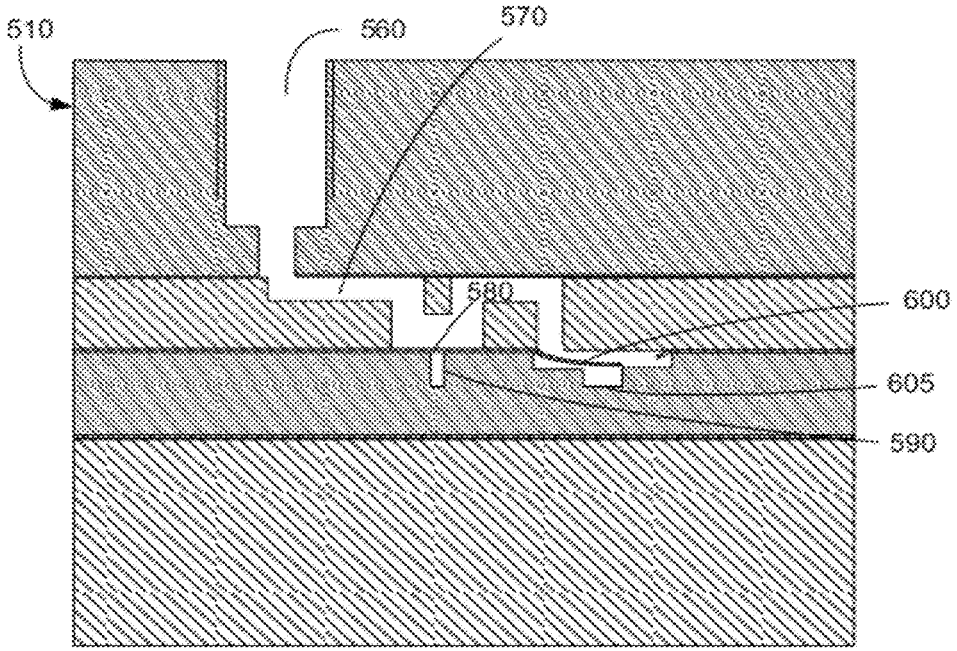
FIG. 8 is a cross-sectional view of the micro-ingredient mixing chamber taken along line 7-7 of FIG. 6.

At the start of a dispense, the on/off valve 547 opens and the water 120 may begin to flow into the micro-mixing chamber 510 at a low flow rate but with high linear velocity. For example, the flow rate may be about one (1) milliliter per second. Other flow rates may be used herein. The micro-ingredient pumps 500 then may begin pumping the desired micro-ingredients 190. As is shown in FIG. 8, the pumping action opens the one-way membrane valve 600 and the ingredients 190 are dispensed into the central water channel 605. The micro-ingredients 190 together with the water 120 flow to the mixing module 210 where they may be combined to produce a final product.

Figure 9:
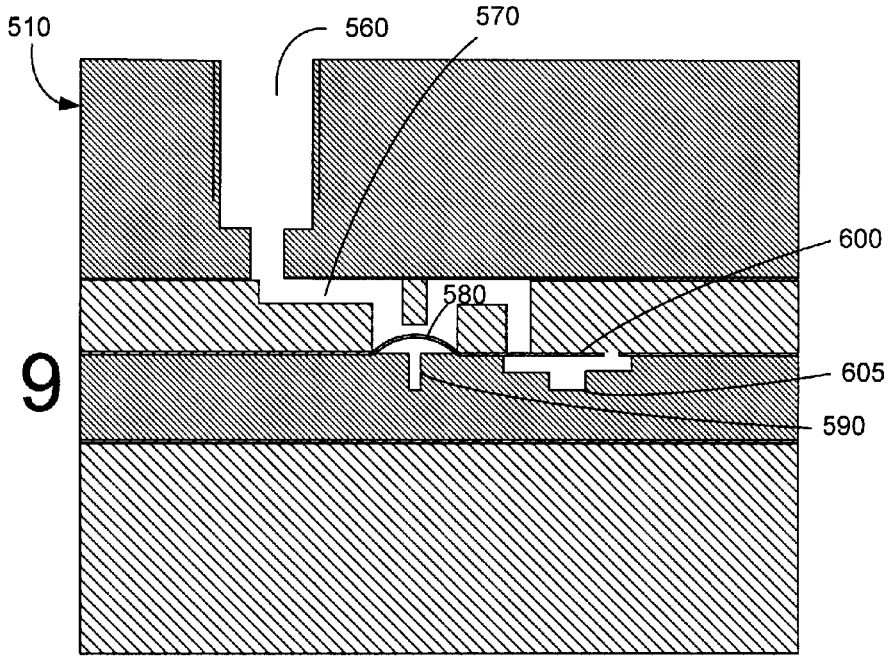
FIG. 9 is a cross-sectional of the micro-ingredient mixing chamber taken along line 7-7 of FIG. 6.
Figure 10:
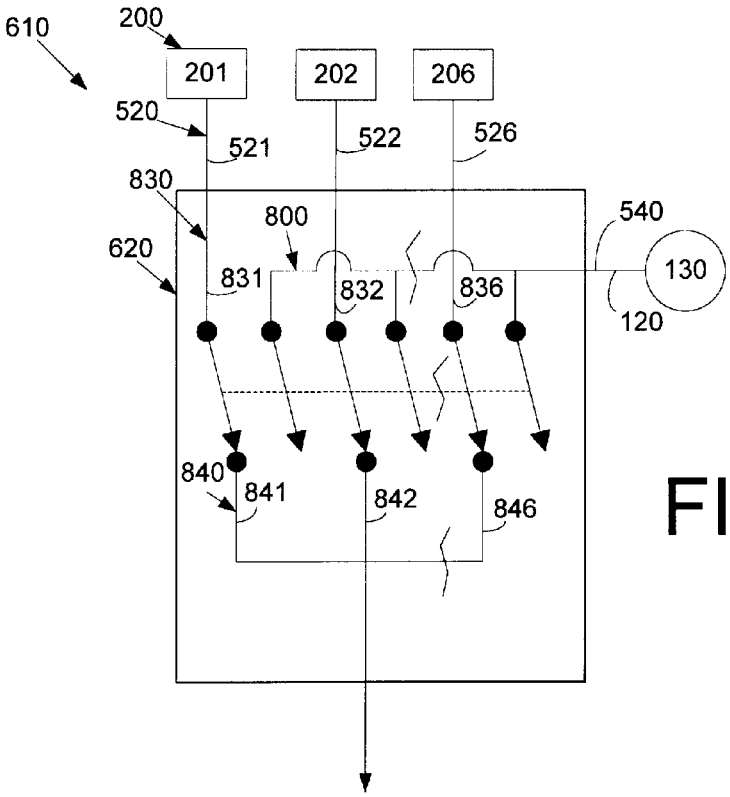
FIG. 10 is a schematic view of a rotary combination chamber as may be described herein in a dispensing position.
Figure 11:
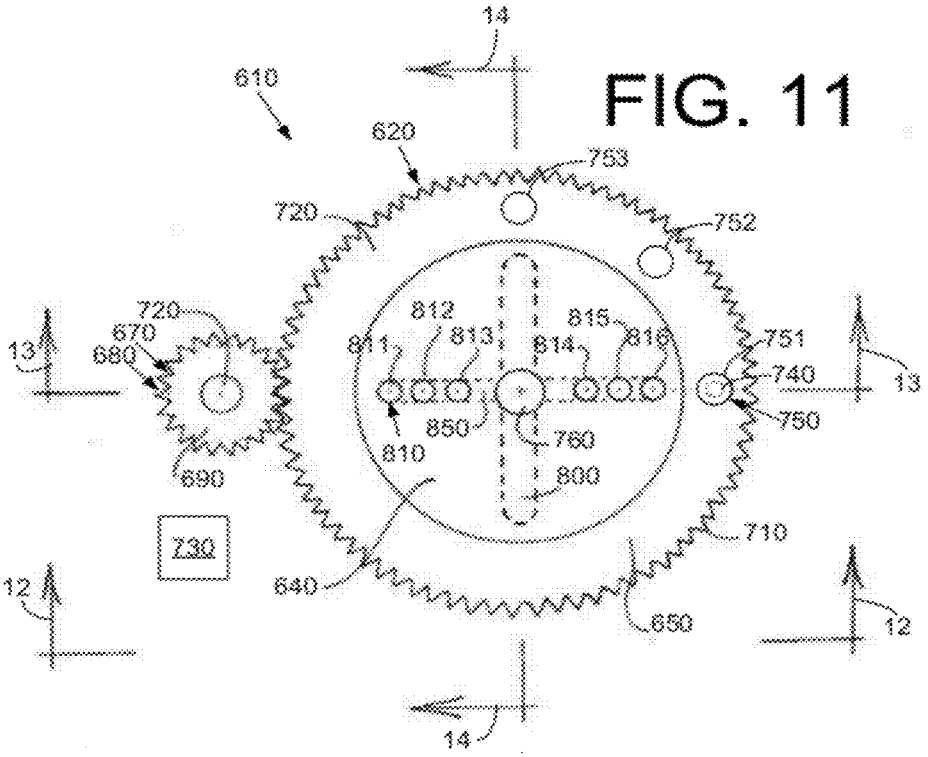
FIG. 11 is a top plan view of the rotary combination chamber of FIG. 10.
Figure 12:
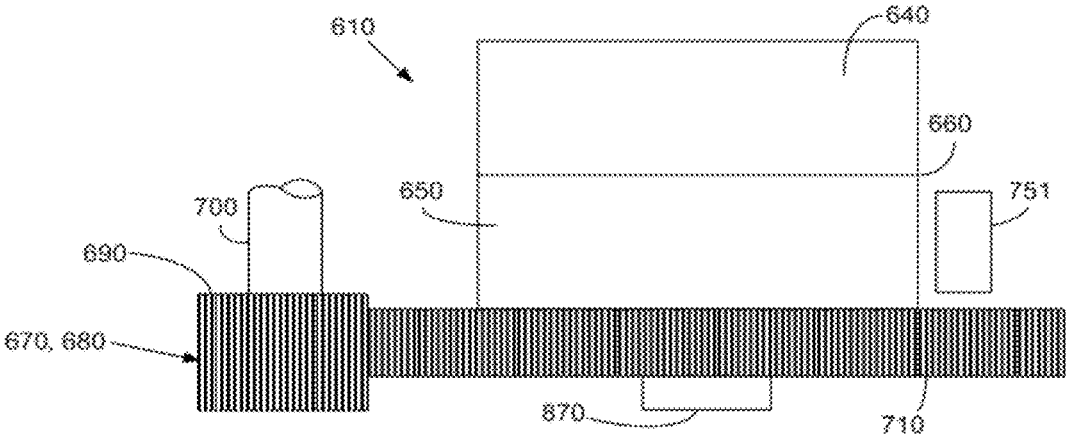
FIG. 12 is a side plan view of the rotary combination chamber of FIG. 10.
Figure 13:
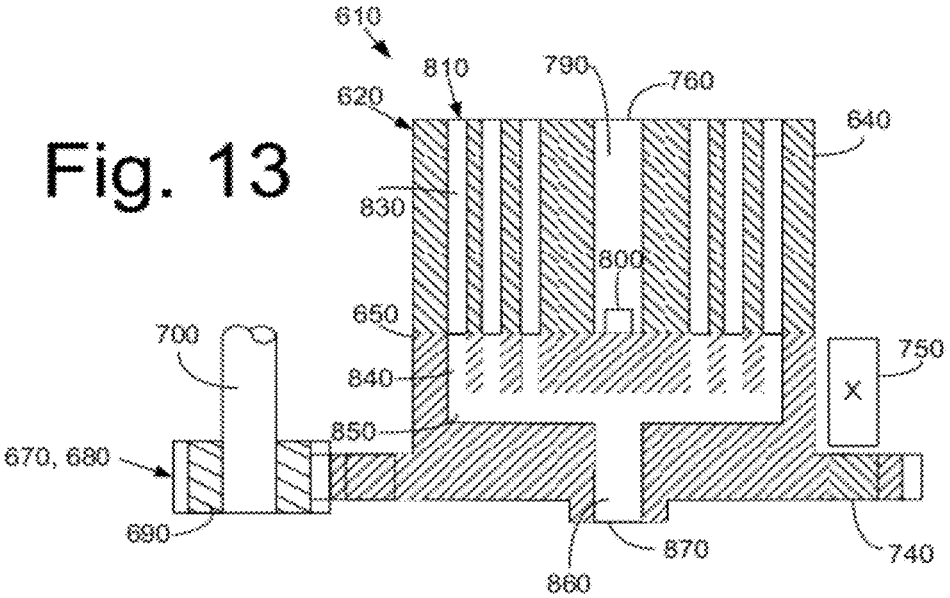
FIG. 13 is a side cross-sectional view of the rotary combination chamber of FIG. 10.
Figure 14:
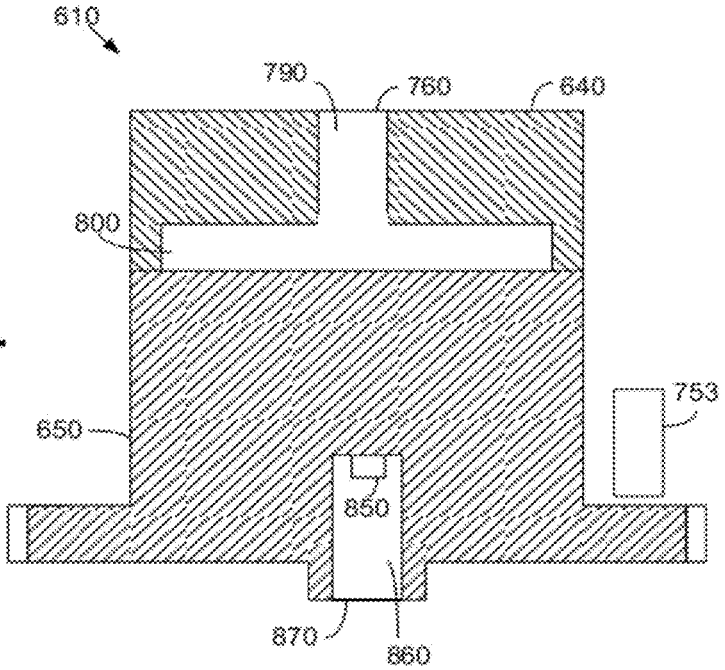
FIG. 14 is a further side cross-sectional view of the rotary combination chamber of FIG. 10.

At the end of the dispense, the micro-ingredient pumps 500 may then stop but the water 120 continues to flow into the micro-ingredient mixer 510. At this time, the pneumatic channel 590 may alternate between a pressurized and a depressurized condition via the three-way valve 555. As is shown in FIG. 9, the membrane 580 deflects when pressurized and displaces any further micro-ingredients 190 from the ingredient channel 570 into the central water channel 605. When depressurized, the membrane 580 returns to its original position and draws a slight vacuum in the ingredient channel 570. The vacuum may ensure that there is no residual backpressure on the one-way membrane valve 600. This helps to ensure that the valve 600 remains closed so as to prevent carryover or micro-ingredient seep therethrough. The flow of water through the micro-ingredient mixer 510 carries the micro-ingredients 190 displaced after the end of the dispense to the combined micro-ingredient line 550 and the mixing module 210.

The micro-ingredients displaced after the end of the dispense then may be diverted to a drain as part of a post-dispense flush cycle. After the post-dispense flush cycle is complete, the valve 547 closes and the central water channel 605 is pressurized according to the setting of the regulator 541. This pressure holds the membrane valve 600 tightly closed. Other components and other configurations may be used herein.

FIGS. 10-14 show an alternative embodiment of the micro-mixing chamber 510, in this example, a rotary combination chamber 610 is shown. Specifically, the rotary combination chamber 610 is shown in a dispense position 620 in FIG. 11. The rotary combination chamber 610 may be in communication with any number of the micro-ingredient sources 200. Although a first micro-ingredient source 201, a second micro-ingredient source 202, and a sixth micro-ingredient source 206 are shown, any number of the micro-ingredient sources 200 may be used herein. Although the use of the micro-ingredients 190 is described herein, the rotary combination chamber 610 may be used with other types of fluids and ingredients.

The rotary combination chamber 610 may include a fixed element 640 and a rotating element 650. The elements 640, 650 may have any desired size, shape, or configuration. The fixed element 640 and the rotating element 650 may meet at interface 660. The fixed element 640 and the rotating element 650 may be made out of materials that offer low friction and smooth sealing properties such as ceramics and the like. Other components and other configurations may be used herein.

The rotary combination chamber 610 also may include a drive mechanism 670 for driving the rotating elements 650. The drive mechanism 670 may be any type of mechanism that imparts rotary motion and the like to the rotating element 650 such as a pinion and gear mechanism 680. Other types of drive mechanisms may be used herein. The pinion and gear mechanism 680 may include a pinion 690 attached to a drive-shaft 700. The driveshaft 700 may be driven by a conventional electric motor (not shown) and the like. The pinion 690 may cooperate with a number of gear teeth 710 mounted on a flange 720 of the rotating element 650 for rotation therewith. The drive mechanism 670 may be operated under the command of a controller 730. The controller 730 may be any type of conventional programmable microprocessor and the like. Other components and other configurations may be used herein.

The flange 720 of the rotating element 650 may have one or more position indicators 740 located thereon. Although one such position indicator 740 is shown, any number of positions indicator 740 may be used herein. The rotary combination chamber 610 also may include a number of sensors 750 positioned about the rotating element 650 so as to cooperate with the position indicator 740. Again, although only three of the sensors 750 are shown, any number of sensors 750 may be used. The sensors 750 interact with the position indicators 740 so as to detect the rotary position of the rotating element 650. When the position indicator 740 aligns with a sensor 751, the dispense position is indicated. When the position indicator 740 aligns with a sensor 752, the sealed position is indicated. When the position indicator 740 aligns with a sensor 753, the wash position is indicated. The sensors 750 and the position indicator 740 may include Hall effect sensors, magnets, optical sensors, reflectors or slots, and the like. The controller 730 thus may operate the drive mechanisms 670 as indicated by the sensors 750 and the positioned indicator 740.

The fixed element 640 may have a water inlet 760. The water inlet 760 may be in communication with a flow of water 120 from a water source 130 via a waterline 780. The water inlet 760 may lead to a vertical water channel 790. The vertical water channel 790 in turn may lead to one or more horizontal water wash channels 800. The horizontal water wash channel 800 may be in the form of an open indentation on a bottom side of the fixed element 640. The horizontal water wash channel 800 may have any size, shape, and configuration.

The fixed element 640 also includes a number of micro-ingredient inlets 810. Although a first micro-ingredient inlet 811, a second micro-ingredient inlet 812, and a sixth micro-ingredient inlet 816 are shown, any number of the micro-ingredients inlets 810 may be used. The micro-ingredient inlets 810 may be in communication with the micro-ingredient sources 200 via a number of the micro-ingredient lines 520. As above, although a first micro-ingredient line 521, a second micro-ingredient line 522, and a sixth micro-ingredient line 526 are shown, any number of the micro-ingredient lines 520 may be used. The micro-ingredient inlets 810 lead to a number of upper vertical channels 830 extending through the fixed elements 640. Although a first upper vertical channel 831, a second micro-ingredient channel 832, and a sixth upper vertical channel 836 are shown, any number of the upper vertical channels 830 may be used. The upper vertical channels 830 may have any size, shape, or configuration. Other components and other configurations may be used herein.

The rotating elements 650 may include a number of lower vertical channels 840. Although a first lower vertical channel 841, a second lower vertical channel 842, and a sixth lower vertical channel 846 are shown, any number of the lower vertical channels 840 may be used. The lower vertical channels 840 may have a similar size, shape, and/or configuration so as to communication with the upper vertical channels 830 of the fixed element 840. The lower vertical channels 840 may lead to a horizontal channel 850 which may lead to a vertical outlet channel 860 and an outlet 870. The outlet 870 may be in communication with the mixing module 210, the nozzle 220, and the like. Other components and other configurations may be used herein.

In use, the controller 730 instructs the drive mechanism 670 to the dispense position 620 of FIGS. 10-14 where the position indicator 740 aligns with the sensor 751. The lower vertical channels 840 of the rotating element 650 thus align with the upper vertical channels 830 of the fixed element 640. One or more of the micro-ingredient pumps 500 then pump the desired micro-ingredients 190 from the micro-ingredient sources 200 through the micro-ingredient lines 520 and the micro-ingredient inlets 810. The micro-ingredients 190 thus flow through the upper vertical channels 830, the lower vertical channels 840, the horizontal channel 850, the vertical outlet channel 860, and the outlet 870. The micro-ingredients 190 then flow to the mixing module 210, the nozzle 220, and the like. Once the appropriate volume of the micro-ingredients 190 has been dispensed, the micro-ingredient pumps 500 may be turned off.

Figure 15:
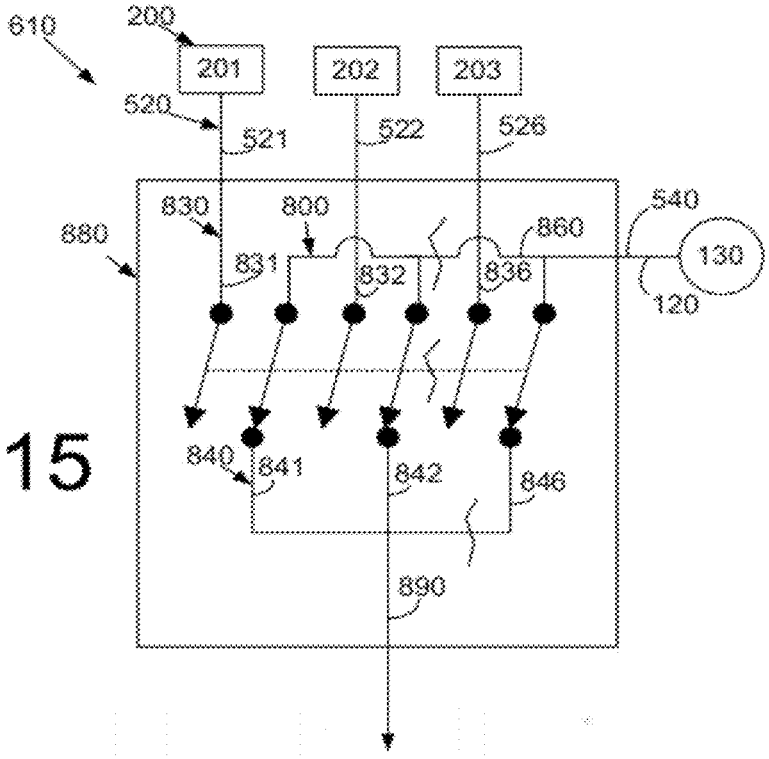
FIG. 15 is a schematic view of the rotary combination chamber in a flush position.
Figure 16:
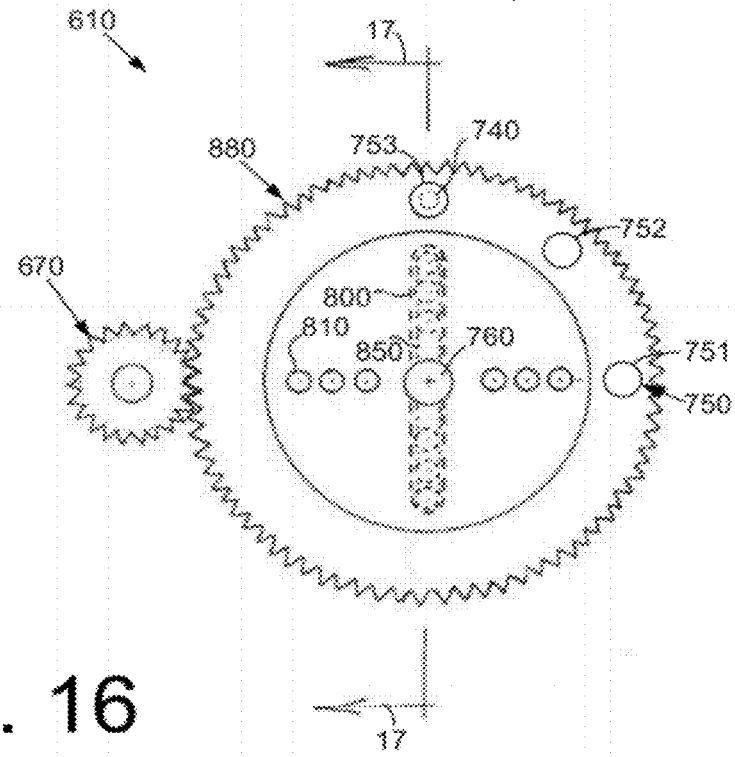
FIG. 16 is a top plan view of the rotary combination chamber of FIG. 15.
Figure 17:
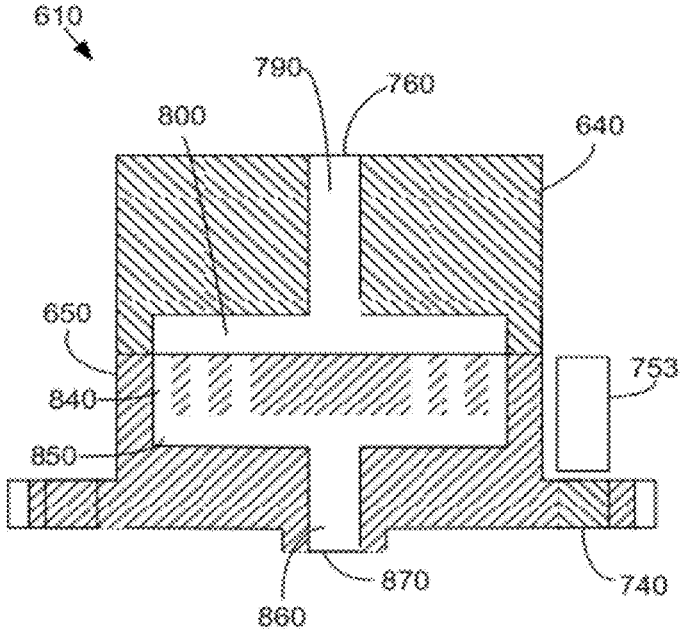
FIG. 17 is a side cross-sectional view of the rotary combination chamber of FIG. 15.
Figure 18:
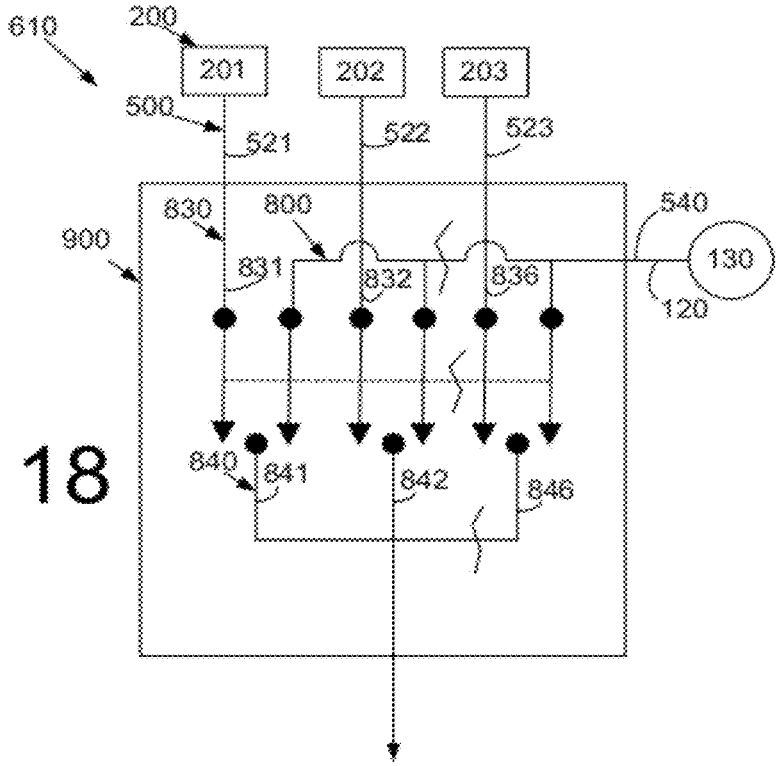
FIG. 18 is a schematic view of the rotary combination chamber in a sealed position.
Figure 19:
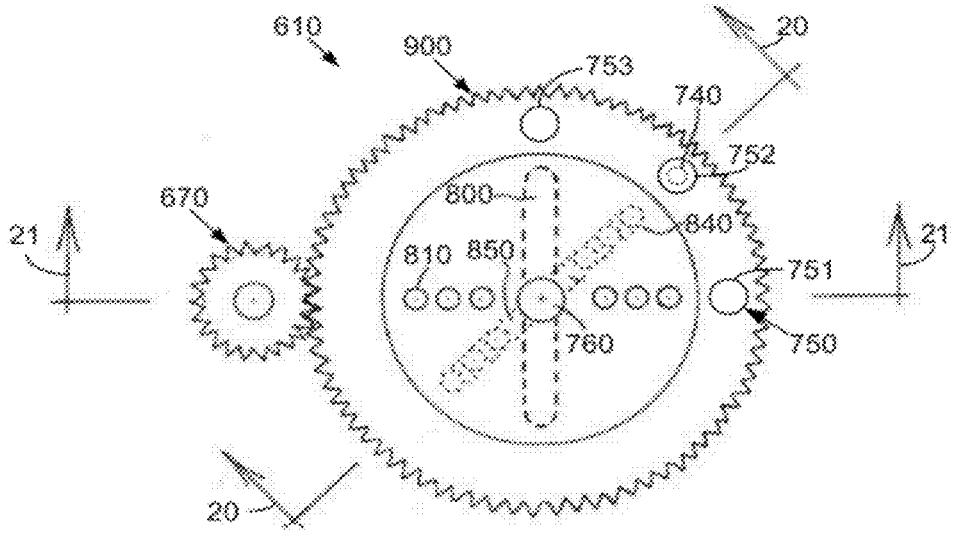
FIG. 19 is a top plan view of the rotary combination chamber of FIG. 18.
Figure 20:
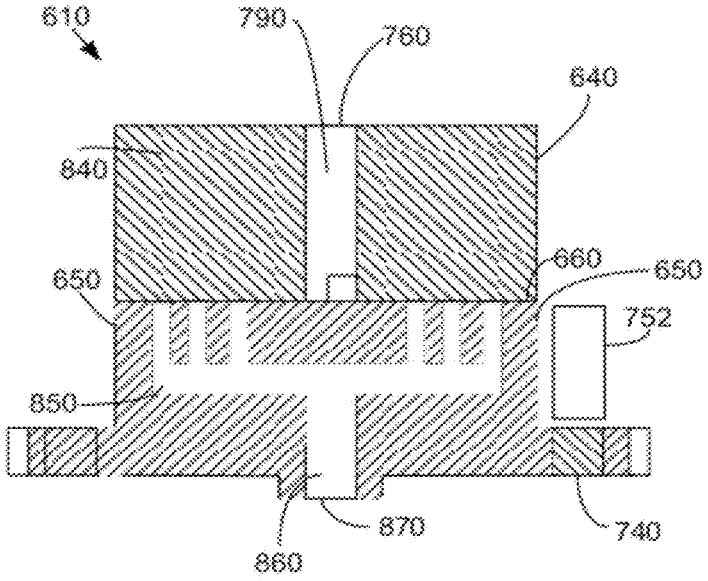
FIG. 20 is a side cross-sectional view of the rotary combination chamber of FIG. 18.

The controller 730 then may instruct the drive mechanism 870 to maneuver the rotating element 650 to a wash position 880 where the positioning indicator 740 aligns with the sensor 753. The wash position 880 is shown in FIGS. 15-17. In the wash position 880, the lower vertical channels 840 of the rotating element 650 align with the horizontal water wash channel 800 of the fixed element 640. A flow of water 120 thus may flow from the waterline 540 into the water inlet 760, through the vertical water channel 790, into the horizontal water wash channel 800, through the lower vertical channels 840, the horizontal channel 850, the vertical channel outlet channel 860, and the outlet 870. The flow of water 120 then may be routed to a drain via a flush diverter and the like.

The rotating element 650 may remain in the wash position 880 for a predetermined amount of time for a timed wash or the wash position 880 may be a transient operation while the rotating element 650 is moving. The flow of water 120 may be continually pressurized in the transient operation with the interface 660 between the fixed element 640 and the rotating element 650 acting as a valve so as to allow only the flow of water 120 into the lower vertical channels 840 when the horizontal water wash channel 800 aligns with the lower vertical channels 840. Given the use of this transient operation, the sensor 753 may not be required. In the non-transient operation, the flow of water 120 may be turned on and off for a predetermined amount of time.

The flow of water 120 thus flows through all of the lower vertical channels 840 of the rotating element 650 so as to wash away all of the traces of the micro-ingredients 190 remaining therein. The upper vertical channels 830 of the fixed element 640 may remain filled with the micro-ingredients 190 and may remain sealed via the interface 660 between the fixed element 640 and the rotating elements 650.

The controller 730 then may instruct the drive mechanism 670 to maneuver the rotating element 650 to a sealed position 900 when the position indicator 740 aligns with the sensor 752. As is shown in FIGS. 18-21, the upper vertical channels 830 with the micro-ingredients 190 therein may be out of alignment with the lower vertical channels 840 so as to seal the micro-ingredients 190 therein. The lower vertical channels 840 may retain the water 120 therein.

When the controller 730 again instructs the drive mechanism 670 to maneuver the rotating element 650 to the dispense position 620, the water 120 that remained in the lower vertical channels 840 may flow to the outlet 870 with the incoming flow of the micro-ingredients 190. The volume of this extra water, however, may be considered minor and therefore insignificant as compared to the incoming micro-ingredient flow. Any water remaining in any of the lower vertical channels 840 that may not be in the current dispensing flow may remain therein so as to act as a buffer to prevent any micro-ingredients 190 in the non-dispensing upper vertical channels 830 from contacting the dispensing stream. Although the non-dispensed micro-ingredients 190 in the upper vertical channels 830 may contact the water in corresponding lower vertical channels 840, the contact time may be sufficiently brief so as to prevent the diffusion of the micro-ingredients 190 through the lower vertical channels 840.

As the rotating element 650 moves from one dispense position 620 to the next, any one of the lower vertical channels 840 may be aligned with any one of the upper vertical channels 830 such that the lower vertical channel 840 may dispense different micro-ingredients 190 on different dispense cycles. Carryover or cross-contamination, however, may be eliminated given the wash position 880. Other components and other configurations may be used herein.

Figure 23:
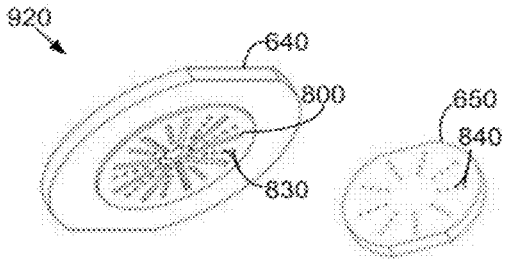
FIG. 23 is an exploded perspective view of an alternative embodiment of a rotary combination chamber as may be described herein.

FIG. 22 shows a further embodiment of a rotary combination chamber 910 as may be described herein. In this example, twelve (12) micro-inlets 810 are shown with two (2) horizontal water wash channels 800. Likewise, FIG. 23 shows a further example of a rotary combination chamber 920 as may be described herein. In this example, thirty six (36) of the micro-ingredient inlets 810 may be used with nine (9) horizontal water wash channels 800. As above, any number of micro-ingredient sources 200 may be used herein.

Figure 24:
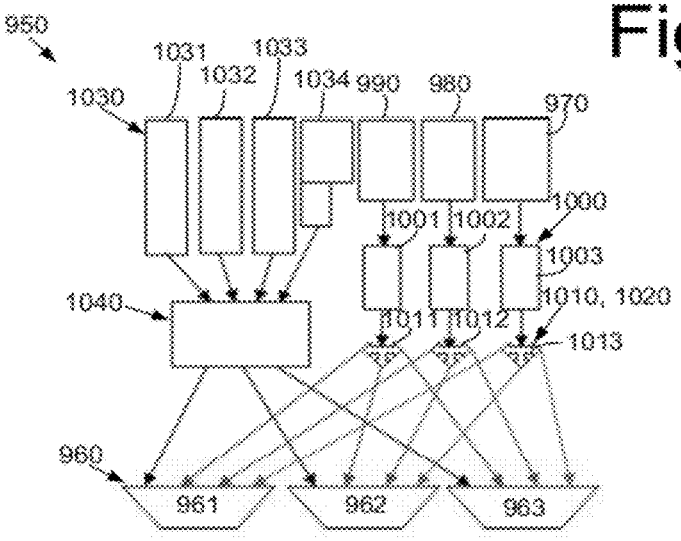
FIG. 24 is a schematic diagram of an alternative embodiment of a beverage dispenser as may be described herein.
Figure 25:
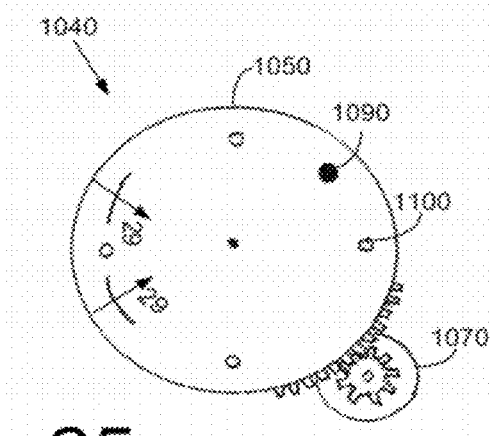
FIG. 25 is a top plan view of a rotary switching chamber as may be described herein.
Figure 26:
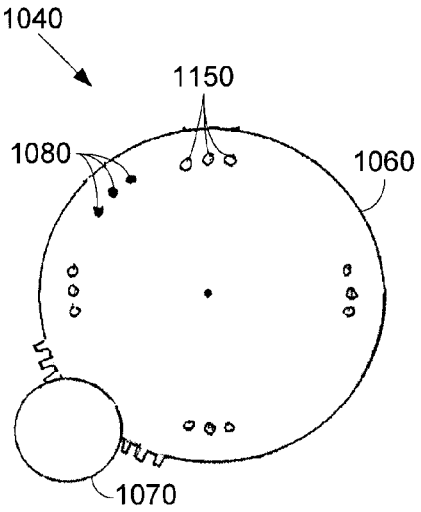
FIG. 26 is a bottom plan view of the rotary switching chamber of FIG. 25.
Figure 27:
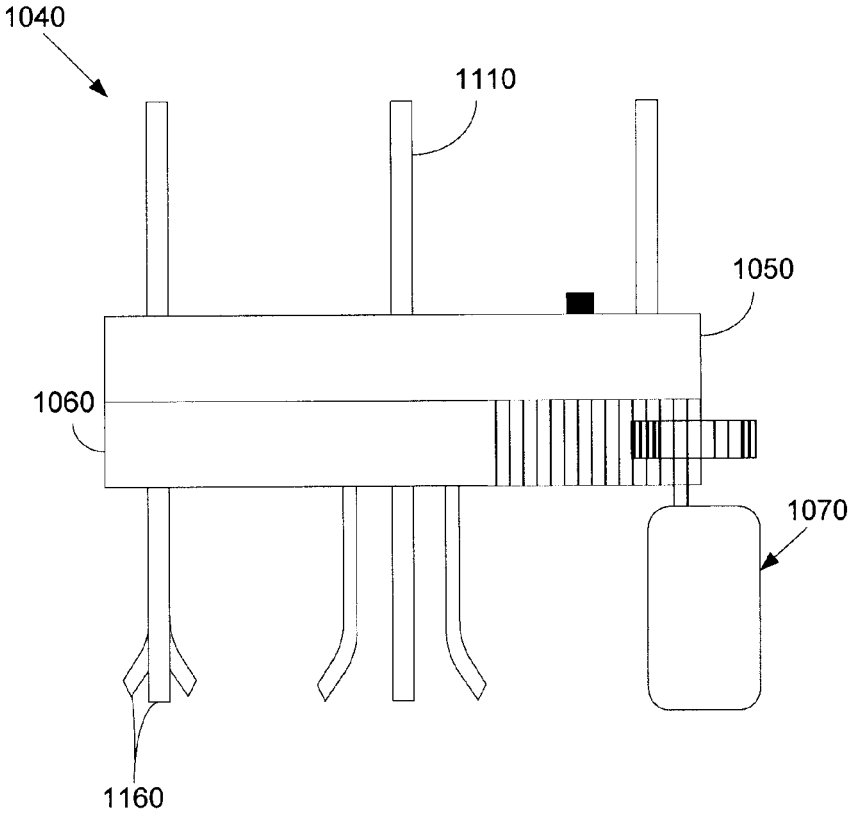
FIG. 27 is a side plan view of the rotary switching chamber of FIG. 25.

FIG. 24 shows a further example of a beverage dispenser 950 as may be described herein. In this example, the beverage dispenser 950 may include a number of nozzles 960. Although a first nozzle 961, a second nozzle 962, and a third nozzle 963 are shown, any number of the nozzles 960 may be used herein. Each of the nozzles 960 may be in communication with one or more sources of carbonated water 970, still water 980, and macro-ingredients 990 such as high fructose corn syrup and other types of sweeteners. The carbonated water source 970, the still water source 980, and the macro-ingredient source 990 may be in communication with the nozzles 960 via a number of flow control modules 1000. Although a first flow control module 1001, a second flow control module 1002, and a third flow control module 1003 are shown, any number of the flow control modules 1000 may be used herein. A diverter valve 1010 may be positioned downstream of each of the flow control modules 1000. Although a first diverter valve 1011, the second diverter valve 1012, and a third diverter valve 1013 are shown, any number of the diverter valves 1010 may be used herein. The diverter valves 1010 may be three-way diverter valves 1020, although other configurations may be used herein. Other components and other configurations may be used herein.

The beverage dispenser 950 also may include a number of micro-ingredient sources 1030 in communication with the nozzles 960. Although a first micro-ingredient source 1031, a second micro-ingredient source 1032, and a third micro-ingredient source 1033 are shown, any number of the micro-ingredient sources 1030 may be used herein. A non-nutritive sweetener source 1034 and the like also may be used herein. Other types of ingredients also may be used herein. Each of the micro-ingredient sources 1030 may be in communication with the nozzles 960 via a rotary switching chamber 1040. Similar to that described above, the rotary switching chamber 1040 may include a fixed element 1050, a rotating element 1060, and a drive mechanism 1070. A number of position indicators 1080 and sensors 1090 also may be used herein.

The fixed element 1050 may include a number of inlets 1100. Although a first inlet 1101, a second inlet 1102, a third inlet 1103, and a fourth inlet 1104 are shown, any number of the inlets 1100 may be used. Each of the inlets 1100 may be in fluid communication with one of the micro-ingredient sources 1030 via an inlet line 1110. Although a first inlet line 1111, a second inlet line 1112, and a third inlet line 1113 are shown, any number of the inlet lines 1110 may be used herein. Each of the inlets 1100 may lead to an upper vertical channel 1120 that extends through the fixed element 1050. Although a first upper vertical channel 1121, a second upper vertical channel 1122, and a third upper vertical channel 1123 are shown, any number of the upper vertical channels 1120 may be used herein. Other components and other configurations may be used herein.

The rotating element 1060 may have a number of lower vertical channel groups 1130. Although a first lower vertical channel group 1131, a second lower vertical channel group 1132, and a third lower vertical channel group 1133 are shown, any number of the vertical channel groups 1130 may be used. Each of the lower vertical channel groups 1130 may have a number of lower vertical channels 1140 therein. Although a first lower vertical channel 1141, a second lower vertical channel 1142, and a third lower vertical channel 1143 are shown, any number of the lower vertical channels 1140 may be used. Each of the lower vertical channels 1140 may be in communication with an outlet 1150. Although a first outlet 1151, a second outlet 1152, and a third outlet 1153 are shown, any number of the outlets 1150 may be used herein. Each outlet 1150 may be in communication with one of the nozzles 960 via, an outlet line 1160. Although a first outlet line 1161, a second outlet line 1162, and a third outlet line 1163 are shown, any number of the outlet lines 1160 may be used herein. Other components and other configurations may be used herein.

Figure 28:
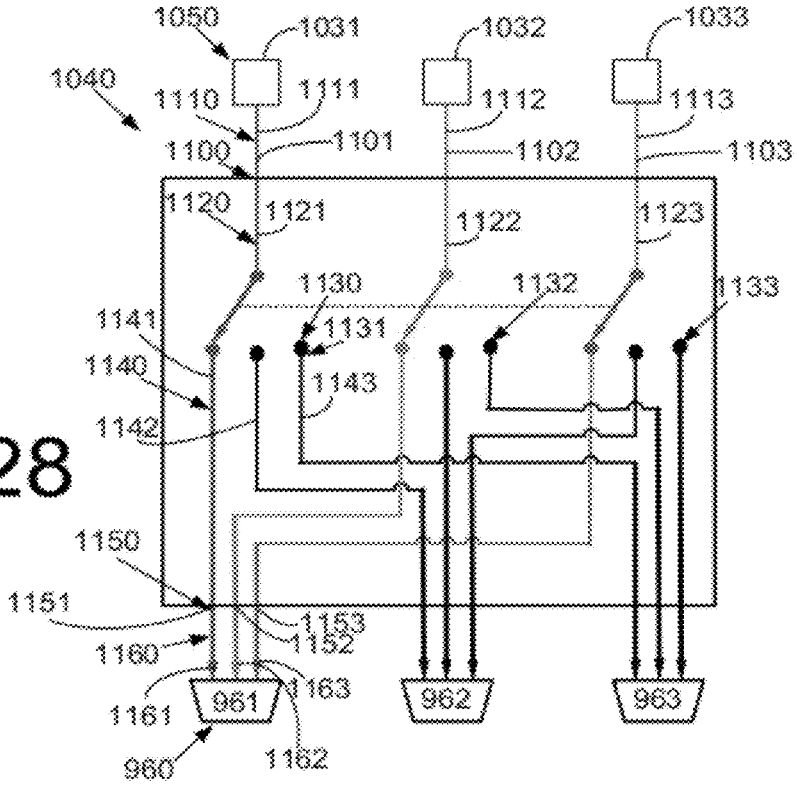
FIG. 28 is a schematic diagram of the rotary switching chamber of FIG. 25 dispensing to a first nozzle.
Figure 29:
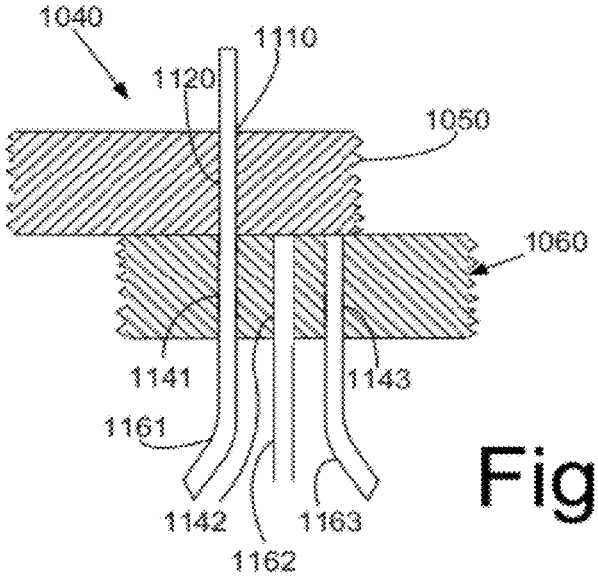
FIG. 29 is a side cross-sectional view of the rotary switching chamber of FIG. 28 taken along section line 29-29 of FIG. 25.
Figure 30:
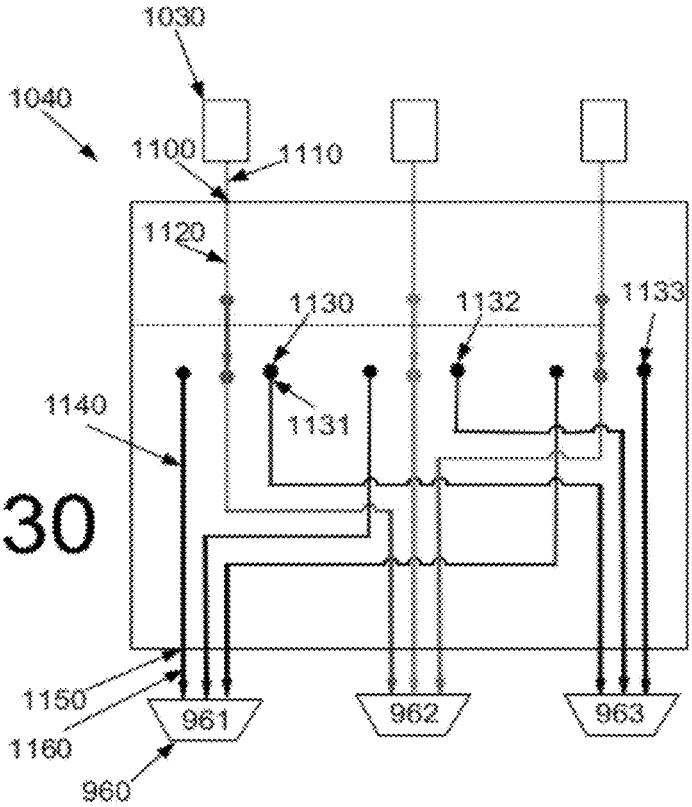
FIG. 30 is a schematic diagram of the rotary switching chamber of FIG. 25 dispensing to a second nozzle.
Figure 31:
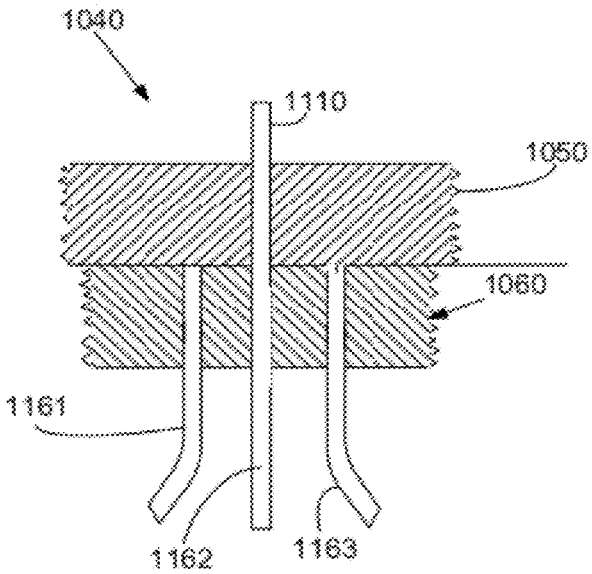
FIG. 31 is a side cross-sectional view of the rotary switching chamber of FIG. 30 taken along section line 29-29 of FIG. 25.
Figure 32:
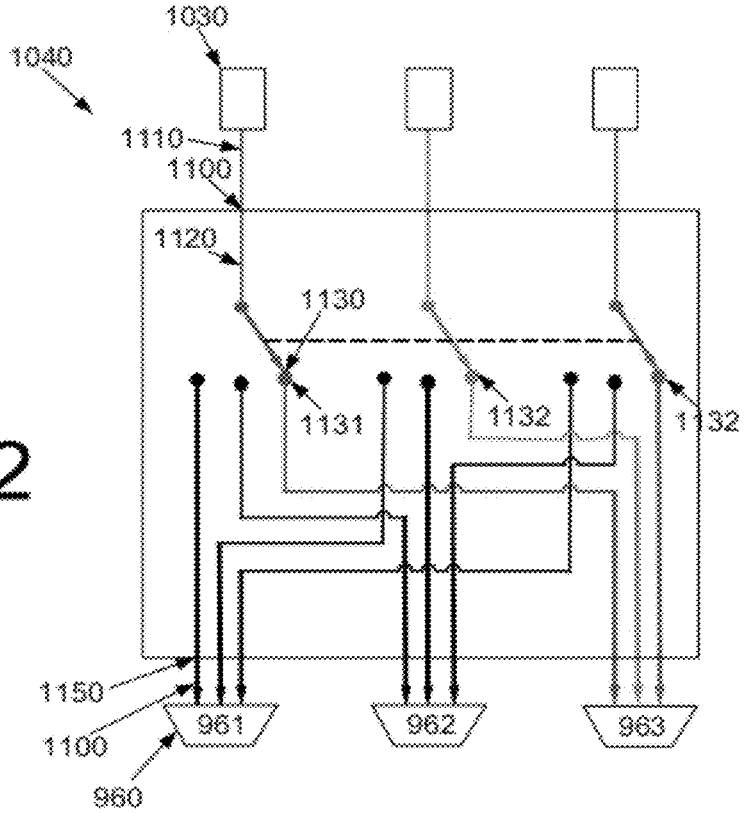
FIG. 32 is a schematic diagram of the rotary switching chamber of FIG. 25 dispensing to a third nozzle.
Figure 33:
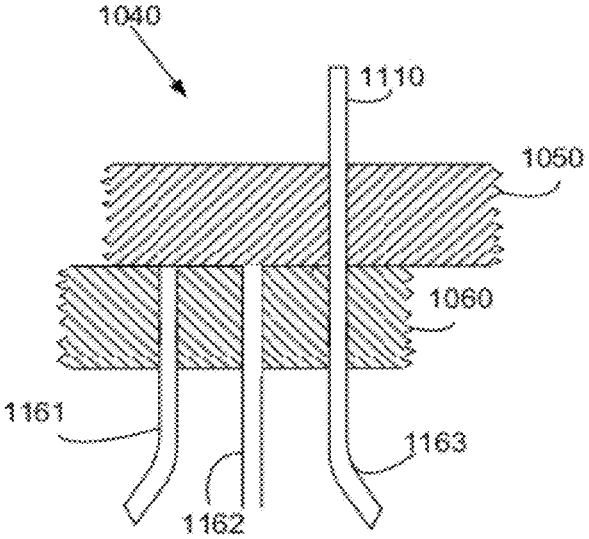
FIG. 33 is a side cross-sectional view of the rotary switching chamber of FIG. 32 taken along section line 29-29 of FIG. 25.
Figure 36:
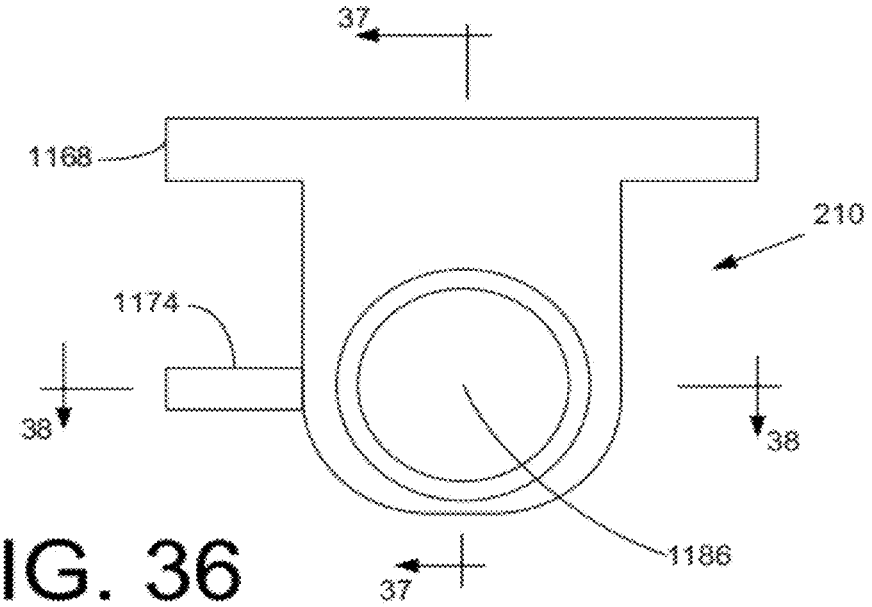
FIG. 36 is a top plan view of the mixing module of FIG. 34.
Figure 37:
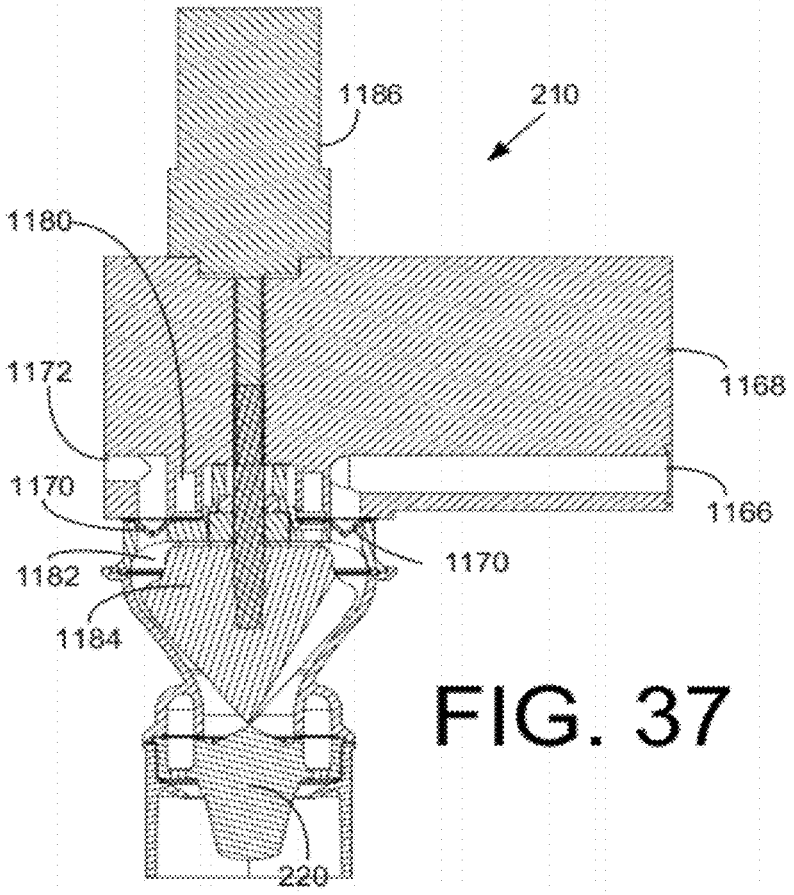
FIG. 37 is a side cross-sectional view of the mixing module taken along lines 37-37 of FIG. 36.
Figure 38:
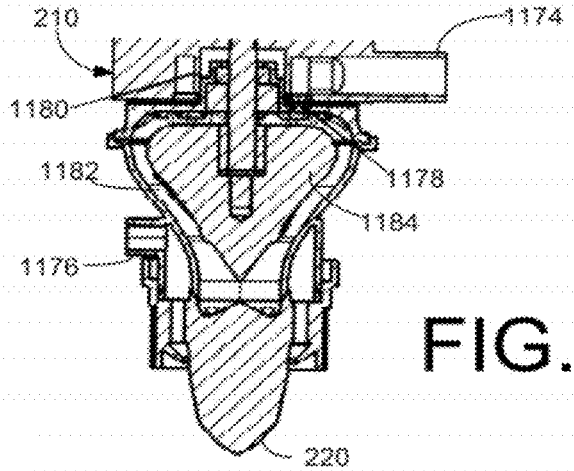
FIG. 38 is a side cross-sectional view of the mixing module taken along lines 38-38 of FIG. 36.
Figure 39:
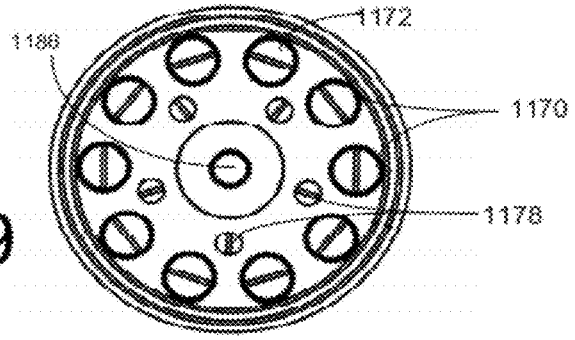
FIG. 39 is a further side cross-sectional view of the mixing module taken along the lines 39-39 of FIG. 35.

FIGS. 28 and 29 show the beverage dispenser 950 configured to dispense to the first nozzle 961. The rotating element 1060 may be rotated until the lower vertical channel 1140 of the appropriate tower vertical channel group 1130 is aligned with the upper vertical channel 1120 of the fixed element 1050 which, in turn, is in communication with the appropriate inlet line 1110 and the appropriate micro-ingredient source 1030. Multiple micro-ingredients 190 thus may be dispensed through the first nozzle 961. Likewise, FIGS. 30 and 31 show dispensing through the second nozzle 962 while FIGS. 32 and 33 show dispensing through the third nozzle 963. Other components and other configurations may be used herein.

FIGS. 34-39 show an example of the mixing module 210 with the nozzle 220 positioned underneath. The mixing module 210 may have a number of macro-ingredient entry ports 1166 as part of a macro-ingredient manifold 1168. The macro-ingredient entry ports 1166 may accommodate the macro-ingredients 170, including the HFCS 340. Nine (9) macro-ingredient entry ports 1166 are shown although any number of the ports 1166 may be used. Each macro-ingredient port 1166 is in fluid communication with the top of the mixing chamber 182 and may be closed by a duckbill valve 1170. Other types of check valves, one way valves, or seating valves may be used herein. The duckbill valves 1170 prevent the backflow of the ingredients 170, 190, 340 and the water 120. Eight (8) of the ports 1166 may be used for the macro-ingredients and one (1) port may be used for the HFCS 340. A micro-ingredient entry port 1176, in communication with the combined micro-ingredient line 550, may enter the top of the mixing chamber 1182 via a duckbill valve 1170.

The mixing module 210 may include a water entry port 1174 and a carbonated water entry port 1176 positioned about the nozzle 220. The water entry port 1174 may include a number of water duckbill valves 1178 or similar types of sealing valves. The water entry port 1174 may lead to an annular water chamber 1180 that surrounds a mixer shaft (as will be described in more detail below). The annular water chamber 1180 may be in fluid communication with the top of a mixing chamber 1182 via five (5) water duckbill valves 1178. The water duckbill valves 1178 may be positioned about an inner diameter of the chamber wall such that the water 120 exiting the water duckbill valves 1178 washes over all of the other duckbill valves 1170 to insure that proper mixing will occur during the dispensing cycle and proper cleaning will occur during a flush cycle. Other types of distribution means may be used herein.

A mixer 1184 may be positioned within the mixing chamber 1182. The mixer 1184 may be an agitator driven by a motor/gear combination 1186. The motor/gear combination 1186 may include a DC motor, a gear reduction box, or other conventional types of drive means. The mixer 1184 rotates at a variable speed depending on the nature of the ingredients being mixed, typically in the range of about 500 to about 1500 rpm so as to provide effective mixing. Other speeds may be used herein. The mixer 1184 may thoroughly combine the ingredients of differing viscosities and amounts to create a homogeneous mixture without excessive foaming. The reduced volume of the mixing chamber 1182 provides for a more direct dispense. The diameter of the mixing chamber 1182 may be determined by the number of macro-ingredients 170 that may be used. The internal volume of the mixing chamber 1182 also is kept to a minimum so as to reduce the loss of ingredients during a flush cycle. The mixing chamber 1182 and the mixer 1184 may be largely onion-shaped so as to retain fluids therein because of centrifugal force when the mixer 1184 is running. The mixing chamber 1182 thus minimizes the volume of water required for flushing.

Figure 40:
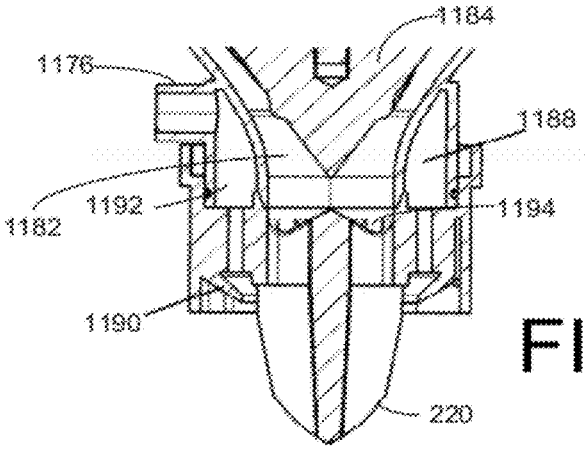
FIG. 40 is an enlargement of the bottom portion of FIG. 38 showing a nozzle.
Figure 43:
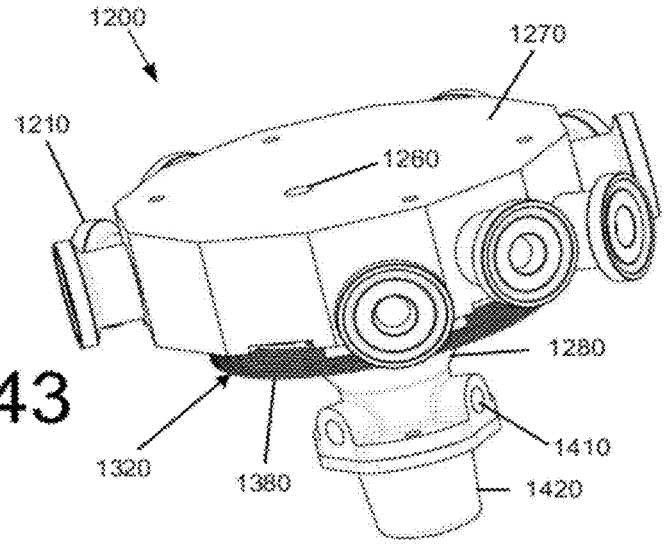
FIG. 43 is a further perspective view of the ingredient mixing module of FIG. 42.
Figure 44:
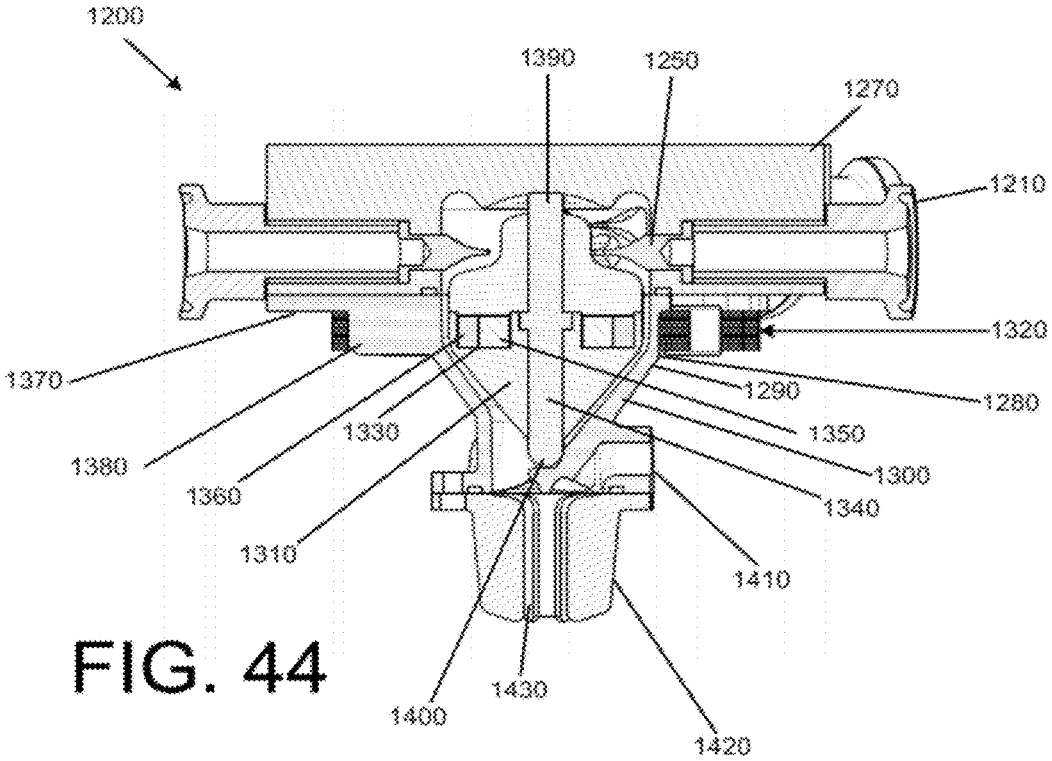
FIG. 44 is a side cross-sectional view of the ingredient mixing module of FIG. 42.
Figure 45:
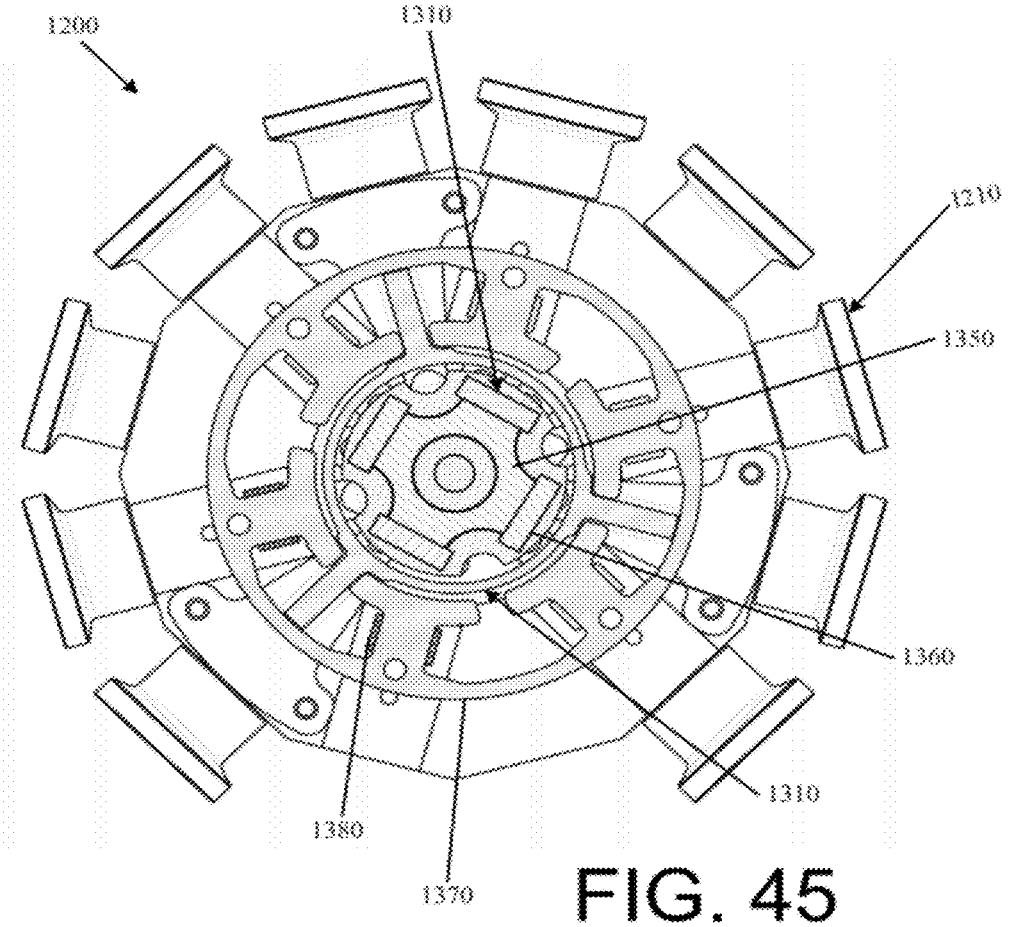
FIG. 45 is a top cross-sectional view of the ingredient mixing module of FIG. 42 taken along section line 45-45 of FIG. 44.
Figure 46:
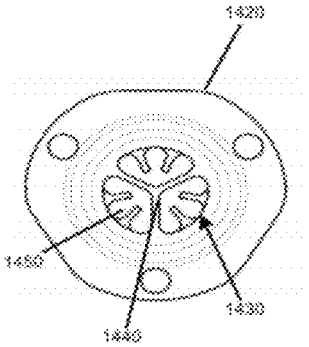
FIG. 46 is a top plan view of a nozzle of the ingredient mixing module of FIG. 42.

As is shown in FIGS. 40 and 41, the carbonated water entry 1176 may lead to an annular carbonated water chamber 1188 positioned just above the nozzle 220 and below the mixing chamber 1182. The annular carbonated water chamber 1188 in turn may lead to a flow deflector 1190 via a number of vertical pathways 1192. The flow deflector 1190 directs the carbonated water flow into the mixed water and ingredient stream so as to promote further mixing. Other types of distribution means may be used herein. The nozzle 220 itself may have a number of exits 1194 and baffles 1196 positioned therein. The baffles 1196 may straighten the flow that may have a rotational component after leaving the mixer 1184. The flow along the nozzle 220 should be visually appealing.

The macro-ingredients 170 (including the HFCS 340), the micro-ingredients 190, and the water 140 thus may be mixed in the mixing chamber 1182 via the mixer 1184. The carbonated water 140 may then be sprayed into the mixed ingredient stream via the flow deflector 1190. Mixing continues as the stream flows down the nozzle 220.

At the completion of a dispense, the flow of the ingredients 120, 140, 170, 190, 340 stops and the mixing chamber 1182 may be flushed with water with the mixer 1184 turned on. The mixer 1184 may run at about 1500 rpm for about three (3) to about five (5) seconds and may alternate between forward and reverse motion (known as Wig-Wag action) to enhance cleaning. Other speeds and times may be used herein depending upon the nature of the last beverage. About thirty (30) milliliters of water may be used in each flush depending upon the beverage although other amounts could be used. While the mixer 1184 is running, the flush water will remain in the mixing chamber 1182 because of centrifugal force. The mixing chamber 1182 will drain once the mixer is turned off. The flush cycle thus largely prevents carry over from one beverage to the next. Other components and other configurations may be used herein.

FIGS. 42-46 show a further example of a mixing module 210. In this case an ingredient mixing module 1200 as may be described herein. The ingredient mixing module 1200 may include a number of middle entry ports 1210. The middle entry ports 1210 may include a number of macro-ingredient entry ports 1220 configured to accommodate the macro-ingredients 170. Although eight (8) macro-ingredient ports 1220 are shown, any number of the macro-ingredient entry ports 1220 may be used herein. The middle entry ports 1210 also may include an HFCS entry port 1230 to accommodate the flow of HFCS 340 and a water entry port 1240 to accommodate the flow of water 120. Other types and numbers of the middle entry ports 1210 may be used herein. Each of the middle entry ports 1210 may be enclosed by a duckbill valve 1250 and the like. Other types of check valves, one-way valves, and/or sealing valves also may be used herein. The duckbill valves 1250 prevent a backflow of the ingredients therein.

The ingredient mixing module 1200 also may include a micro-ingredient entry port 1260. The micro-ingredient port 1260 may be positioned about a top surface 1270 of the ingredient mixing module 1200. The micro-ingredient port 1260 may accommodate the flow of the micro-ingredients 190 from the micro-ingredient mixing chamber 510, from the rotary combination chamber 610, the rotary switching chamber 1040, or elsewhere. A duckbill valve 1250 and the like also may be used herein.

The middle entry ports 1210 and the micro-ingredient entry port 1260 may lead to a mixing chamber 1280. The mixing chamber 1280 may have an onion-like configuration 1290 formed by the walls 1300 thereof. The middle entry ports 1210 may enter the mixing chamber 1280 radially about the walls 1300 of the mixing chamber 1280 to promote good mixing. Other components and other configurations may be used herein.

A mixer 1310 may be positioned within the mixing chamber 1280. The mixer 1310 also may have a complimentary onion-like configuration 1290 with respect to the mixing chamber 1280. The mixer 1310 acts as an agitator within the mixing chamber 1280. The ingredient mixing module 1200 may thoroughly combine ingredients of different viscosities and amounts to create a homogeneous mixture without excessive foaming. The reduced volume of the mixing chamber 1280 provides for a more direct dispense. The use of the onion-like configuration 1290 of the mixing chamber 1280 and the mixer 1310 helps to maintain the fluids therein because of centrifugal force.

The mixer 1310 may be driven by a brushless motor 1320. The brushless motor 1320 thus magnetically drives the mixer 1310 within the mixing chamber 1280. Specifically, the mixer 1310 acts as a rotor 1330 for the brushless motor 1320. As such, the mixer 1310 includes a central shaft 1340. The central shaft 1340 may be surrounded by a laminated soft iron core 1350. Likewise, a number of permanent magnets 1360 may surround the laminated soft iron core 1350. The brushless motor 1320 further may include a laminated soft iron stator 1370. The laminated soft stator 1370 may be positioned outside the walls 1300 of the mixing chamber 1280. A number of electromagnetic windings 1380 may be positioned about the laminated soft iron stator 1370. Other components and other configurations may be used herein.

Electrification of the windings 1380 of the laminated soft iron stator 1370 thus attracts the permanent magnets 1360 of the mixer 1310 acting as the rotor 1330. This magnetic attraction thus drives the mixer 1310. In this example, the use of four (4) of the permanent magnets 1360 makes the mixer 1310 function as a two (2) pole rotor. The brushless motor 1320 may be connected to a brushless DC controller (not shown). The use of the brushless motor 1320 provides additional space within the mixing chamber 1280. The brushless motor 1320 also provides reliability with increased sanitation. Specifically, the brushless motor 1320 eliminates the need for shaft seals therein to drive the mixer 1310. The brushless motor 1320 also allows for RPM control without the need of an encoder. Other components and other configurations may be used herein.

The mixer 1310 may be positioned between a top bearing surface 1390 and a bottom bearing surface 1400. The top and bottom bearing surfaces 1390, 1400 allow the fluids within the mixing chamber 1280 to contact all surfaces of the mixer 1310 and the bearing surfaces 1390, 1400 themselves. The mixing chamber 1280 thus may have a flow through configuration without dead legs or sharp corners so as to be compatible with the clean-in-place sanitizing process.

A number of carbonated water entry ports 1410 may be positioned about the bottom bearing surface 1400 at the bottom of the mixing chamber 1280. The carbonated water entry ports 1410 may be integrated into the walls 1300 of the mixing chamber 1280 that supports the bottom bearing surface 1400. Although three (3) carbonated water entry ports 1410 are shown, any number of the carbonated water entry ports 1410 may be used herein. Varying levels of carbonation may be used herein. The carbonated water entry ports 1410 may be angled away from the mixing chamber 1280 so as to create a central flow with a reduced velocity. Reducing the velocity may limit the decarbonation of the flow therethrough. Other components and other configurations may be used herein.

A nozzle 1420 may be positioned downstream of the mixing chamber 1280. The nozzle 1420 may be removable for cleaning. The nozzle 1420 may have a number of internal fins 1430 positioned therein. The internal fins 1430 may include number of complete fins 1440 and a number of partial fins 1450. The fins 1430 may have any size, shape, or configuration. Although nine (9) fins 1430 are shown herein, any number of the fins 1430 may be used. The fins 1430 serve to straighten the flow therethrough while reducing the amount of foam. Other components and configurations may be used herein.

The macro-ingredients 170, the HFCS 340, and the micro-ingredients 190 and water 120 thus may be mixed within the ingredient mixing module 1200 via the mixer 1310. The mixer 1310 may rotate at varying speeds depending upon the type of ingredients being mixed. The carbonated water 140 then may be added to the stream upstream of the nozzle 1420. The ingredients continue to mix as the stream continues down the nozzle 1420 and into the consumer's cup. The timing of the entry of the macro-ingredients, the HFCS, the micro-ingredients 190, the water 120, and the carbonated water 140 may be varied to achieve the homogeneous flow and prevent foaming.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A beverage dispenser, comprising:

a plurality of micro-ingredients;

a first water stream;

a rotary chamber;

wherein the rotary chamber comprises a first element in communication with the plurality of micro-ingredients and the first water stream; and a second element selectively maneuverable to a dispense position for one of the plurality of micro-ingredients and to a sealed position;

a second water stream; and a nozzle in communication with the second water stream and the rotary chamber for mixing and dispensing both the one of the plurality of micro-ingredients and the second water stream.

2. The beverage dispenser of claim 1, wherein the rotary chamber comprises a rotary switching chamber.

3. The beverage dispenser of claim 1, wherein the plurality of micro-ingredients comprises a plurality of micro-ingredients with reconstitution ratios of about ten to one or higher.

4. The beverage dispenser of claim 1, wherein the plurality of micro-ingredients comprises a plurality of micro-ingredients with reconstitution ratios of about twenty to one or higher.

5. The beverage dispenser of claim 1, wherein the plurality of micro-ingredients comprise a plurality of micro-ingredient sources in communication with the rotary chamber via a plurality of micro-ingredient lines.

6. The beverage dispenser of claim 1, wherein the rotary chamber comprises a drive mechanism.

7. The beverage dispenser of claim 6, wherein the drive mechanism comprises a pinion and gear system.

8. The beverage dispenser of claim 6, wherein the drive mechanism is in communication with a plurality of sensors positioned about a position indicator.

9. The beverage dispenser of claim 1, wherein the first element comprises a fixed element and the second element comprises a rotating element.

10. The beverage dispenser of claim 9, wherein the stationary element comprises a plurality of upper vertical channels in communication with the plurality of micro-ingredients.

11. The beverage dispenser of claim 10, wherein the rotating element comprises a plurality of lower vertical channels that may align with the plurality of upper vertical channels.

12. A beverage dispenser, comprising:

a water stream;

a plurality of micro-ingredients;

a rotary chamber;

wherein the rotary chamber comprises a fixed element in communication with the plurality of micro-ingredients and a rotating element for the passage of one of the plurality of micro-ingredients; and a plurality of dispensing nozzles in communication with the water stream and the rotating element of the rotary chamber for simultaneously mixing and dispensing both the water stream and the one of the plurality of micro-ingredients through a selected one of the plurality of dispensing nozzles.

13. The beverage dispenser of claim 12, wherein the rotary chamber comprises a rotary switching chamber.

14. The beverage dispenser of claim 12, wherein the plurality of micro-ingredients comprises a plurality of micro-ingredients with reconstitution ratios of about ten to one or higher.

15. The beverage dispenser of claim 12, wherein the water stream is in communication with the plurality of dispensing nozzles via a diverter valve.

16. The beverage dispenser of claim 12, wherein the fixed element comprises a plurality of upper vertical channels in communication with the plurality of micro-ingredients.

17. The beverage dispenser of claim 16, wherein the rotating element comprises a plurality of lower vertical channels that may align with the plurality of upper vertical channels.

18. The beverage dispenser of claim 16, wherein one of the lower vertical channels is in communication with one of the plurality of dispensing nozzles.

19. A beverage dispenser, comprising:

a water stream;

a plurality of micro-ingredients;

a rotary chamber; and a plurality of dispensing nozzles;

wherein the water stream is in communication with the plurality of dispensing nozzles via a diverter valve for the passage of the water stream to a selected one of the plurality of dispensing nozzles; and wherein the rotary chamber comprises a fixed element in communication with the plurality of micro-ingredients and a rotating element for the passage of one of the plurality of micro-ingredients to the selected one of the plurality of dispensing nozzles for simultaneous mixing with the water stream.

20. The beverage dispenser of claim 19, further comprising a plurality of water streams in communication with the diverter valve.

* * * * *